US008630439B2

(12) United States Patent
Nagumo et al.

(10) Patent No.: US 8,630,439 B2
(45) Date of Patent: Jan. 14, 2014

(54) ACOUSTIC CONVERSION DEVICE AND ACOUSTIC CONVERSION DEVICE ASSEMBLY METHOD

(75) Inventors: Tsutomu Nagumo, Saitama (JP); Koji Matsuda, Saitama (JP); Koji Nageno, Tokyo (JP); Takeshi Hara, Kanagawa (JP); Takahiro Suzuki, Saitama (JP); Takayuki Ishii, Chiba (JP); Kenji Hiraiwa, Saitama (JP)

(73) Assignee: Sony Corporation, Tokyo (JP)

( * ) Notice: Subject to any disclaimer, the term of this patent is extended or adjusted under 35 U.S.C. 154(b) by 335 days.

(21) Appl. No.: 13/104,674

(22) Filed: May 10, 2011

(65) Prior Publication Data

US 2011/0311088 A1 Dec. 22, 2011

(30) Foreign Application Priority Data

Jun. 17, 2010 (JP) ..... 2010-137897

(51) Int. Cl.
*H04R 1/02* (2006.01)

(52) U.S. Cl.
USPC ..... 381/395; 381/318; 381/412; 381/417

(58) Field of Classification Search
USPC ..... 381/318, 395, 395.412, 417, 418
See application file for complete search history.

(56) References Cited

U.S. PATENT DOCUMENTS 6,804,369 B2 * 10/2004 Masuda et al. ..... 381/417
2001/0022844 A1 * 9/2001 Urushibata et al. ..... 381/318

FOREIGN PATENT DOCUMENTS

JP 2007-074499 3/2007
JP 2007074499 A * 3/2007

* cited by examiner

*Primary Examiner* — Duc Nguyen
*Assistant Examiner* — Phan Le
(74) *Attorney, Agent, or Firm* — Dentons US LLP

(57) ABSTRACT

An acoustic conversion device includes: a driving unit including magnets, a yoke, a coil, a vibrating portion, and an armature fixed to the yoke; a diaphragm unit including a holding frame fixed to the driving unit, with one face as a first-joint face jointed to the driving unit, and the other face as a second-joint face, a resin film adhered to the holding frame, a diaphragm held on the holding frame, and a beam portion propagating vibration from the vibrating portion to the diaphragm; and a storage unit including a case body for storing the driving unit and diaphragm unit; with the driving unit and diaphragm unit being stored in the case body, the case body being pressed against and deforming a sealing agent loaded in the second-joint face, from a side facing the second-joint face, thereby sealing each gap between the case body, cover body, and holding frame.

6 Claims, 21 Drawing Sheets

ACOUSTIC CONVERSION DEVICE AND ACOUSTIC CONVERSION DEVICE ASSEMBLY METHOD

BACKGROUND

The present disclosure relates to a technical field regarding acoustic conversion devices and acoustic conversion device assembly methods, and specifically relates to a technical field for realizing improvement in workability in assembly work by pressedly deforming a sealing agent loaded in a holding frame by a cover body to seal a gap of each portion.

There is an acoustic conversion device which serves as a small speaker having an oscillator referred to as an armature which is integrated into various types of audio output device such as headphones, earphones, audiphones, and so forth.

With such an acoustic conversion device, a driving unit including an armature, and a diaphragm unit including a diaphragm are housed in a storage case having an audio output hole, vibration is propagated to the diaphragm by a beam portion when a vibration portion of the armature vibrates, and the propagated vibration is output as audio (e.g., see Japanese Unexamined Patent Application Publication No. 2007-74499).

The storage case is made up of a case body opened in one direction, and a cover which closes this case body, and the storage case and the cover are combined sandwiching the diaphragm unit therebetween.

With the above acoustic conversion device, in order to prevent sound leakage from other than the audio output hole to the outside, both gaps of a gap between the storage case and the diaphragm unit, and a gap between the cover and the diaphragm have to be sealed by a sealing agent.

SUMMARY

However, with the acoustic conversion described in Japanese Unexamined Patent Application Publication No. 2007-74499, an arrangement is made wherein the storage case and the cover are combined sandwiching the diaphragm unit therebetween, and accordingly, with assembly work, sealing of a gap between the storage case and the diaphragm unit, and sealing of a gap between the cover and the diaphragm unit has to be performed individually.

Accordingly, with the assembly work of the acoustic conversion device, sealing of each portion has to be performed individually, which has a problem in that workability is poor.

It has been found to be desirable to provide an acoustic conversion device and an acoustic conversion device assembly method, which can overcome the above problem, whereby improvement in workability of assembly work can be realized.

An acoustic conversion device according to an embodiment of the present disclosure includes: a driving unit including a pair of magnets disposed so as to face one another, a yoke to which the pair of magnets are attached, a coil to which driving current is supplied, a vibrating portion which vibrates when driving current is supplied to the coil, and an armature fixed to the yoke and disposed between the pair of magnets with the vibrating portion being passed through the coil; a diaphragm unit including a holding frame having an opening, fixed to the driving unit, with one face being taken as a first joint face to be jointed to the driving unit, and a face on the opposite side of the one face being taken as a second joint face, a resin film adhered to the holding frame in a state covering the opening of the holding frame, a diaphragm held on the inner side of the holding frame in a state adhered to the resin film, and a beam portion of which both edge portions are combined with the diaphragm and the vibrating portion of the armature respective, for propagating the vibration of the vibrating portion to the diaphragm; and a storage unit having a case body and a cover body for storing the driving unit and the diaphragm unit, in which an audio output hole for outputting audio generated at the time of vibration being propagated to the diaphragm is formed; with a state in which the driving unit and the diaphragm unit are inserted into the case body, the cover body being pressed against a sealing agent loaded in the second joint face of the holding frame from a side facing the second joint face such that the sealing agent is pressedly deformed, thereby sealing each gap between the case body, the cover body, and the holding frame by the sealing agent.

Accordingly, the sealing agent is pressedly deformed by the cover body, and accordingly, each gap between the case body, cover body, and holding frame is filled up with the sealing agent.

An arrangement may be made wherein a pair of side face portions which face one another in a direction orthogonal to a direction where the pair of magnets face are provided to the yoke, a pair of fixed portions fixed to the outer faces of a pair of side face portions of the yoke respectively are provided to the armature, each of the armature and the holding frame is formed of a metal material, the first joint face of the holding frame is jointed to the pair of fixed portions of the armature by laser welding so that the diaphragm unit is fixed to the driving unit, each edge face to which the first joint face in the pair of fixed portions is jointed is formed as a fixing face, and a wall portion protruding on the first joint face side from each of the fixing faces is provided to the pair of side face portions.

The wall portion protruding on the first joint face side from the fixing face is provided to the pair of side face portions of the yoke, and accordingly, metal which scatters at the time of laser welding collides with the wall portion of the yoke.

An arrangement may be made wherein a pair of side face portions which face one another in a direction orthogonal to a direction where the pair of magnets face are provided to the yoke, a pair of fixed portions fixed to the outer faces of a pair of side face portions of the yoke respectively are provide to the armature, each of the armature and the holding frame is formed of a metal material, the first joint face of the holding frame is jointed to the pair of fixed portions of the armature by laser welding so that the diaphragm unit is fixed to the driving unit, each edge face to which the first joint face in the pair of fixed portions is jointed is formed as a fixing face, and a wall portion protruding on the first joint face side from each of the fixing faces positioned in the inner side of each of the fixing faces is provided to the pair of fixed portions.

The pair of fixed portions of the armature are each positioned in the inner side of the fixed face, and the wall portion protruding on the first joint face side from the fixing portion is provided, and accordingly, metal which scatters at the time of laser welding collides with the wall portion of the armature.

An arrangement may be made wherein a pair of side face portions which face one another in a direction orthogonal to a direction where the pair of magnets face are provided to the yoke, each of the yoke and the holding frame is formed of a metal material, the first joint face of the holding frame is jointed to the pair of side face portions of the yoke by laser welding so that the diaphragm unit is fixed to the driving unit, each edge face to which the first joint face in the pair of side face portions is jointed is formed as a fixing face, and a wall portion protruding on the first joint face side from each of the fixing faces positioned in the inner side of each of the fixing faces is provided to the pair of side face portions.

The wall portion protruding on the first joint face side from each of the fixing faces positioned in the inner side of each of the fixing faces is provided to the pair of side face portions of the yoke, and accordingly, metal which scatters at the time of laser welding collides with the wall portion of the yoke.

An arrangement may be made wherein in a state in which the driving unit and the diaphragm unit are inserted into the case body, the lower faces of the holding frame and the cover body is disposed so as to be lower than the upper face of the case body, and also disposed in the inner side.

In a state in which the driving unit and the diaphragm unit are inserted into the case body, the lower faces of the holding frame and the cover body are disposed so as to be lower than the upper face of the case body, and also disposed in the inner side, and accordingly, a gap is formed between the inner face of the case body and the outer face of the cover body.

An acoustic conversion device assembly method according to an embodiment of the present disclosure includes: inserting a driving unit including a pair of magnets, a yoke to which the pair of magnets are attached, and a coil to which a driving current is supplied, a vibrating portion, and an armature fixed to the yoke, and a diaphragm unit including a holding frame fixed to the driving unit, with one face being taken as a first joint face to be jointed to the driving unit, and a face on the opposite side of the one face being taken as a second joint face, a resin film adhered to the holding frame, a diaphragm held on the holding frame in a state adhered to the resin film, and a beam portion for propagating the vibration of the vibrating portion to the diaphragm, into a case body opened in one direction; loading a sealing agent in the second joint face of the holding frame; pressing a cover body which closes the opening of the case body against the sealing agent from a side facing the second joint face such that the sealing agent is pressedly deformed; and sealing each gap between the case body, the cover body, and the holding frame by the sealing agent.

Accordingly, the sealing agent is pressedly deformed by the cover body, and accordingly, each gap between the case body, cover body, and holding frame is filled up with the sealing agent.

An acoustic conversion device according to an embodiment of the present disclosure includes: a driving unit including a pair of magnets disposed so as to face one another, a yoke to which the pair of magnets are attached, a coil to which driving current is supplied, a vibrating portion which vibrates when driving current is supplied to the coil, and an armature fixed to the yoke and disposed between the pair of magnets with the vibrating portion being passed through the coil; a diaphragm unit including a holding frame having an opening, fixed to the driving unit, with one face being taken as a first joint face to be jointed to the driving unit, and a face on the opposite side of the one face being taken as a second joint face, a resin film adhered to the holding frame in a state covering the opening of the holding frame, a diaphragm held on the inner side of the holding frame in a state adhered to the resin film, and a beam portion of which both edge portions are combined with the diaphragm and the vibrating portion of the armature respective, for propagating the vibration of the vibrating portion to the diaphragm; and a storage unit having a case body and a cover body for storing the driving unit and the diaphragm unit, in which an audio output hole for outputting audio generated at the time of vibration being propagated to the diaphragm is formed; with a state in which the driving unit and the diaphragm unit are inserted into the case body, the cover body being pressed against a sealing agent loaded in a second joint face of the holding frame from a side facing the second joint face such that the sealing agent is pressedly deformed, thereby sealing each gap between the case body, the cover body, and the holding frame by the sealing agent.

Accordingly, a single task of covering the holding frame by the cover body to pressedly deform the sealing agent results in each gap between the holding frame, cover body, and case body being sealed, and improvement in workability with acoustic conversion device assembly work can be realized.

An arrangement may be made wherein a pair of side face portions which face one another in a direction orthogonal to a direction where the pair of magnets face are provided to the yoke, a pair of fixed portions fixed to the outer faces of a pair of side face portions of the yoke respectively are provided to the armature, each of the armature and the holding frame is formed of a metal material, the first joint face of the holding frame is jointed to the pair of fixed portions of the armature by laser welding so that the diaphragm unit is fixed to the driving unit, each edge face to which the first joint face in the pair of fixed portions is jointed is formed as a fixing face, and a wall portion protruding on the first joint face side from each of the fixing faces is provided to the pair of side face portions.

Accordingly, damage of the resin film can be prevented by a simple technique without increase in manufacturing costs.

An arrangement may be made wherein a pair of side face portions which face one another in a direction orthogonal to a direction where the pair of magnets face are provided to the yoke, a pair of fixed portions fixed to the outer faces of a pair of side face portions of the yoke respectively are provide to the armature, each of the armature and the holding frame is formed of a metal material, the first joint face of the holding frame is jointed to the pair of fixed portions of the armature by laser welding so that the diaphragm unit is fixed to the driving unit, each edge face to which the first joint face in the pair of fixed portions is jointed is formed as a fixing face, and a wall portion protruding on the first joint face side from each of the fixing faces positioned in the inner side of each of the fixing faces is provided to the pair of fixed portions.

Accordingly, the armature can be fixed to the yoke without taking the heights of the edge faces of the yoke and the fixing faces of the armature into consideration, whereby damage of the resin film can be prevented in addition to realizing improvement in the flexibility in designing.

An arrangement may be made wherein a pair of side face portions which face one another in a direction orthogonal to a direction where the pair of magnets face are provided to the yoke, each of the yoke and the holding frame is formed of a metal material, the first joint face of the holding frame is jointed to the pair of side face portions of the yoke by laser welding so that the diaphragm unit is fixed to the driving unit, each edge face to which the first joint face in the pair of side face portions is jointed is formed as a fixing face, and a wall portion protruding on the first joint face side from each of the fixing faces positioned in the inner side of each of the fixing faces is provided to the pair of side face portions.

Accordingly, damage of the resin film can be prevented in addition to realizing reduction in the size of the acoustic conversion device.

An arrangement may be made wherein in a state in which the driving unit and the diaphragm unit are inserted into the case body, the lower faces of the holding frame and the cover body is disposed so as to be lower than the upper face of the case body, and also disposed in the inner side.

Accordingly, a gap is formed between the inner face of the case body and the outer face of the cover body, and the sealing agent is filled in the gap, whereby the gaps between the holding frame, cover body, and case body can readily be sealed.

An acoustic conversion device assembly method according an embodiment of the present disclosure includes: inserting a driving unit including a pair of magnets, a yoke to which the pair of magnets are attached, and a coil to which a driving current is supplied, a vibrating portion, and an armature fixed to the yoke, and a diaphragm unit including a holding frame fixed to the driving unit, with one face being taken as a first joint face to be jointed to the driving unit, and a face on the opposite side of the one face being taken as a second joint face, a resin film adhered to the holding frame, a diaphragm held on the holding frame in a state adhered to the resin film, and a beam portion for propagating the vibration of the vibrating portion to the diaphragm, into a case body opened in one direction; loading a sealing agent in the second joint face of the holding frame; pressing a cover body which closes the opening of the case body against the sealing agent from a side facing the second joint face such that the sealing agent is pressedly deformed; and sealing each gap between the case body, the cover body, and the holding frame by the sealing agent.

Accordingly, adhesion of metal which scattered by laser irradiation to the resin film can be prevented, and damage of the resin film can be prevented.

DETAILED DESCRIPTION OF EMBODIMENTS

Hereafter, an embodiment of the present disclosure will be described in accordance with the appended drawings.

With the following description, directions of forward, backward, upper, lower, left, and right will be used in relation to a direction in which audio is output, which is forward.

Note that the directions of forward, backward, upper, lower, left, and right shown below are for convenience of description, and implementation of the present disclosure is not restricted to these directions.

Entire Configuration

Figure 1:
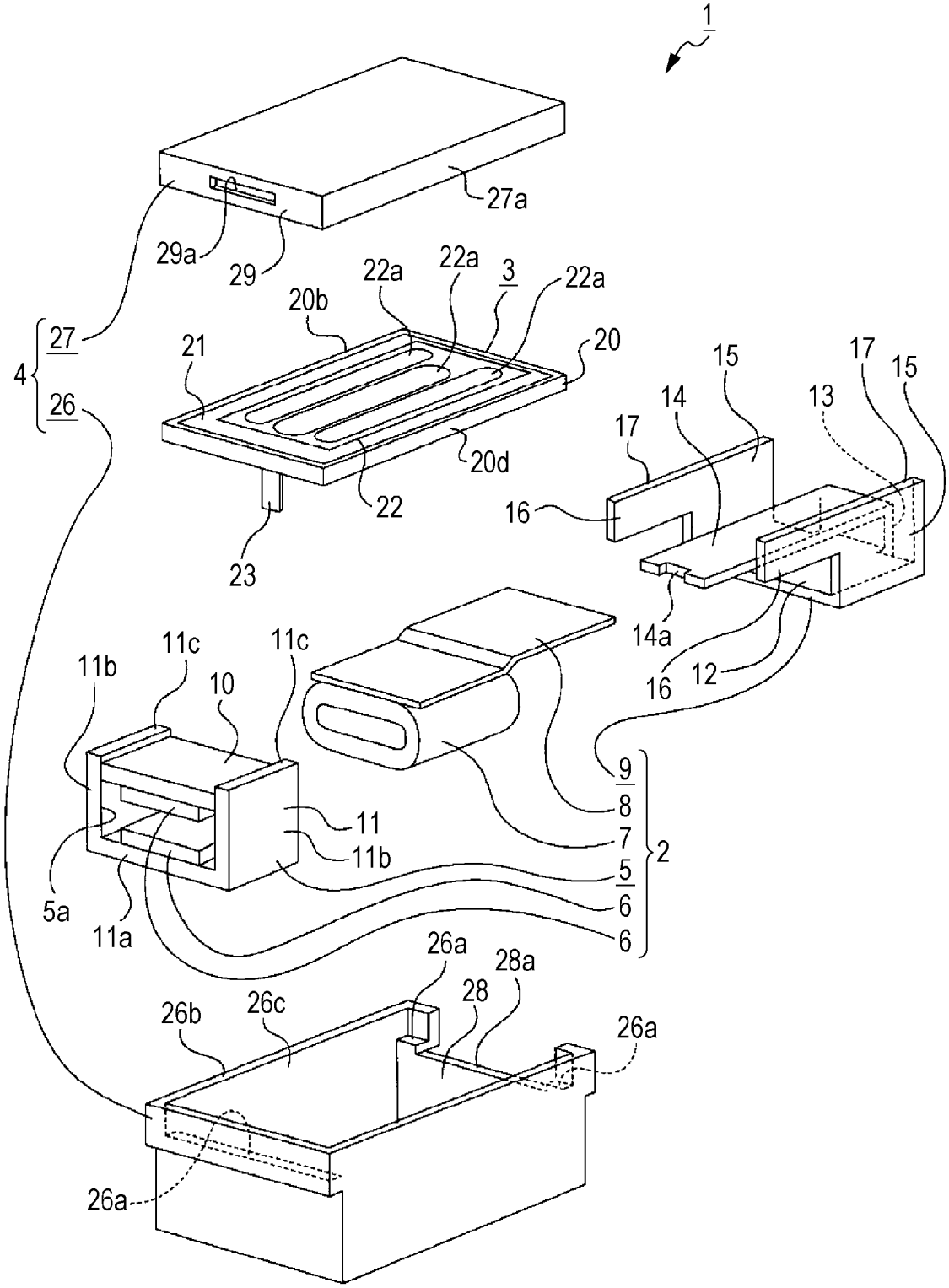
FIG. 1 is an exploded perspective view of an acoustic conversion device, which illustrates an embodiment of the present disclosure along with FIGS. 2 through 32.
Figure 2:
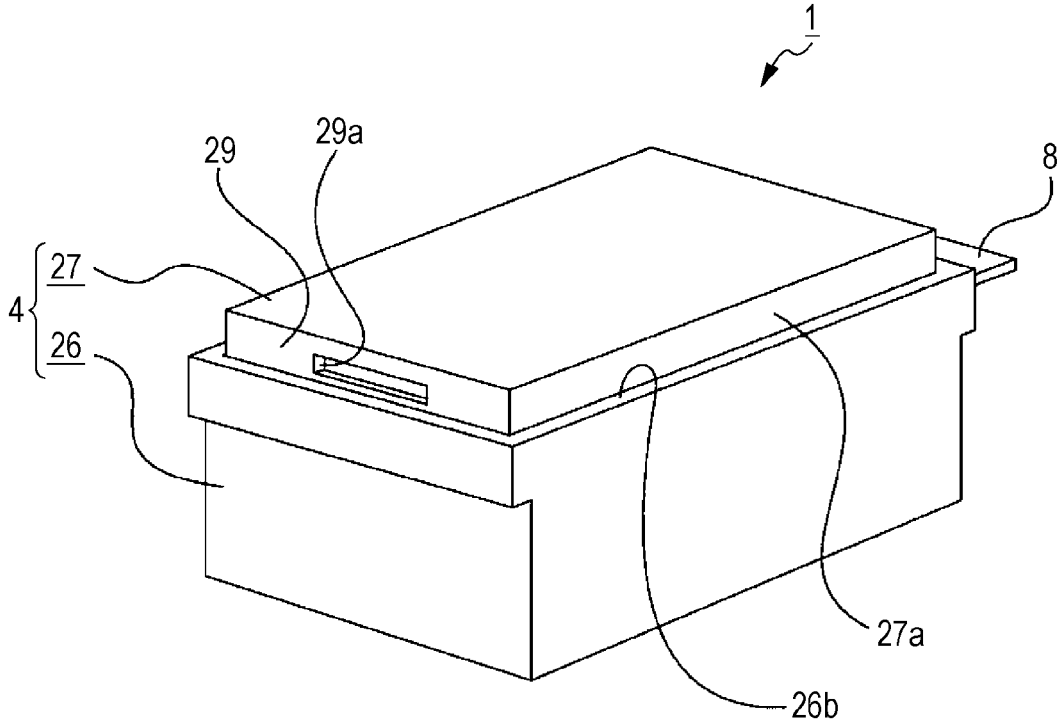
FIG. 2 is an enlarged perspective view of the acoustic conversion device.
Figure 3:
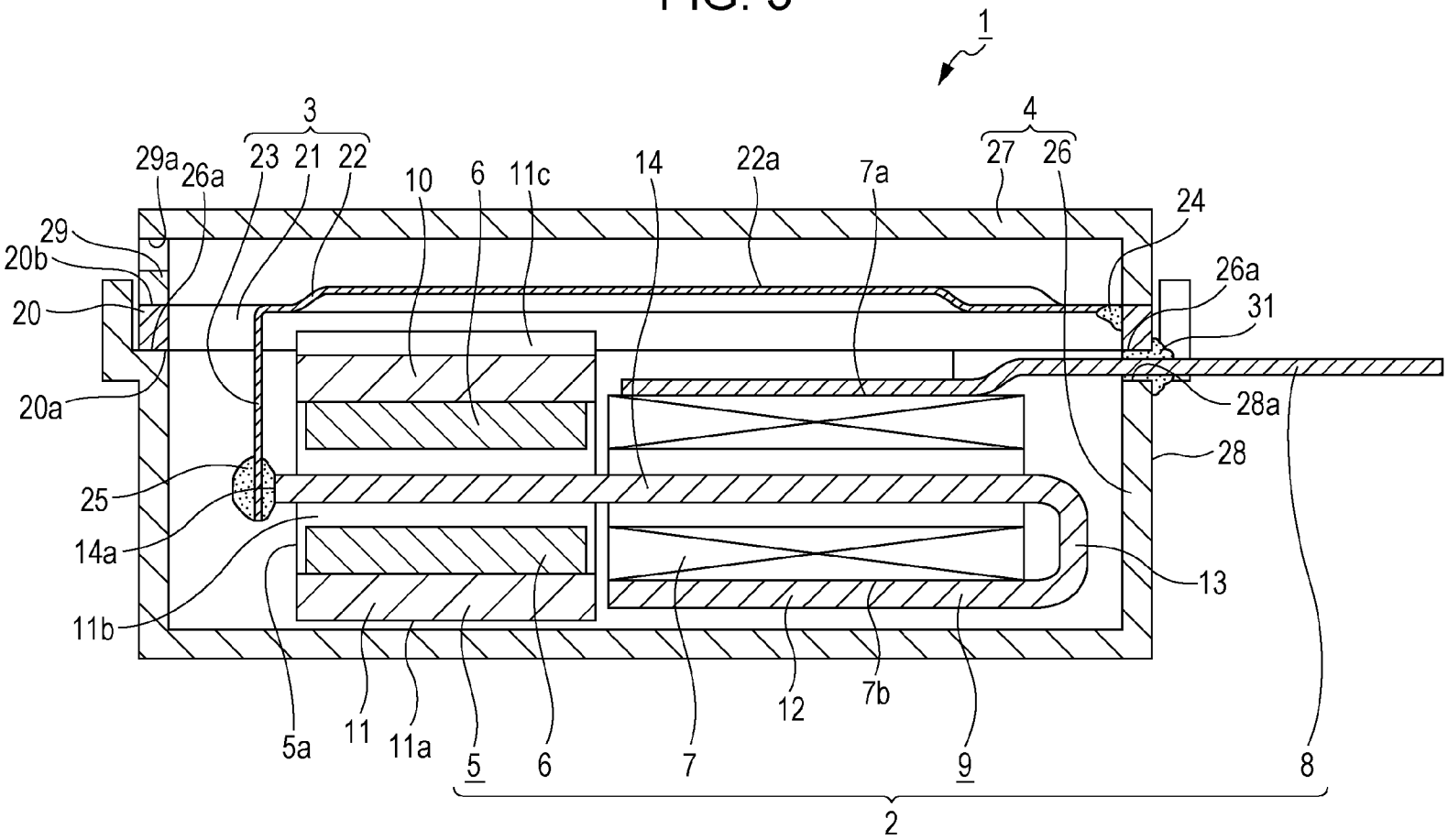
FIG. 3 is an enlarged cross-sectional view of the acoustic conversion device.

An acoustic conversion device 1 is configured of a driving unit 2, a diaphragm unit 3, and a storage unit 4 (see FIGS. 1 through 3).

The driving unit 2 is configured of a yoke 5, a pair of magnets 6, a coil 7, a circuit board 8, and an armature 9 (see FIGS. 2 and 3).

The yoke 5 is configured by a plate-shaped first member 10 directed in the vertical direction, and a U-shaped second member 11 opened upward being combined. The second member 11 is configured of a bottom face portion 11*a* directed in the vertical direction, and side face portions 11*b* protruding upward from both of left and right edge portions of this bottom face portion 11*a*.

With the first member 10, both of left and right side faces are attached to the inner faces of the side faces 11*b* of the second member 11, for example, by adhesion or the like, respectively. The yoke 5 is formed in a square tubular shape where the first member 10 and the second member 11 are combined and pierced backward and forward, and the opening on the front side is formed as a working opening 5*a*.

The magnets 6 are disposed in a state isolated in the vertical direction and mutually facing, and the poles on the facing sides are made up of a different pole. The magnet 6 located upward is attached to the lower face of the first member 10, and the magnet 6 located downward is attached to the upper face of the bottom face portion 11*a* in the second member 11.

As described above, the yoke 5 is configured of the first member 10 and the second member 11.

Accordingly, distance between the first member 10 and the bottom face portion 11*a* of the second member 11 can be adjusted, and optimization of distance (L shown in FIG. 4) between the magnets 6 used for securing suitable magnetic properties can be realized. In particular, the distance L between the magnets 6 depends on the thickness of an adhesive agent for attaching the magnets 6 to the yoke 5, and the thickness of a later-described vibrating portion of an armature 9 to be inserted into the magnets 6, and accordingly, it is extremely effective for securing suitable magnetic properties and suitable ease of assembly that the distance L between the magnets 6 can be adjusted.

Also, in a state before the first member 10 and the second member 11 are combined, the magnets 6 can be attached to the first member 10 and the second member 11, respectively. Accordingly, insertion of the magnets 6 into the internal space of the yoke 5 integrally formed in a frame shape so as to perform attachment work does not have to be performed, and accordingly, attachment work of the magnets 6 as to the yoke 5 can readily be performed with high precision.

Note that joining between the first member 10 and the second member 11 is performed by inserting an unshown spacer between the magnets 6, or confirming the distance L by image processing.

Figure 5:
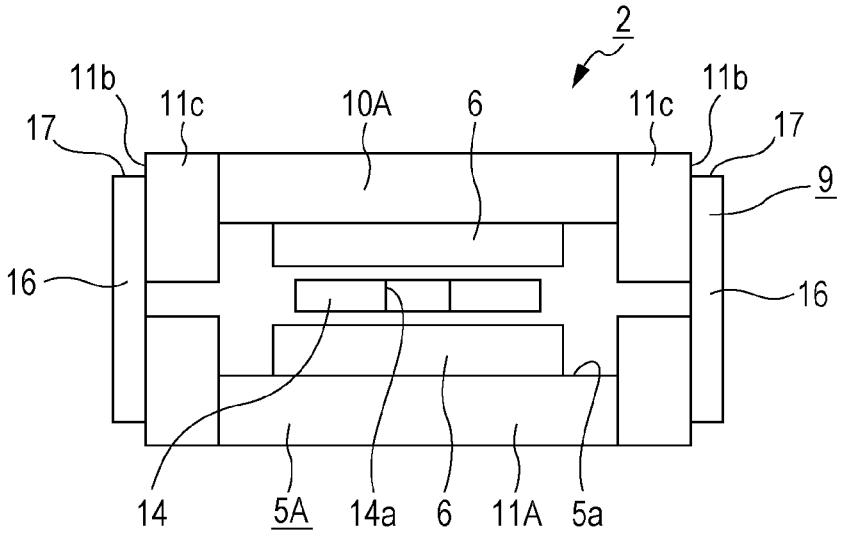
FIG. 5 is an enlarged front view of the driving unit indicating an example wherein a first member and a second member differ in shapes.
Figure 6:
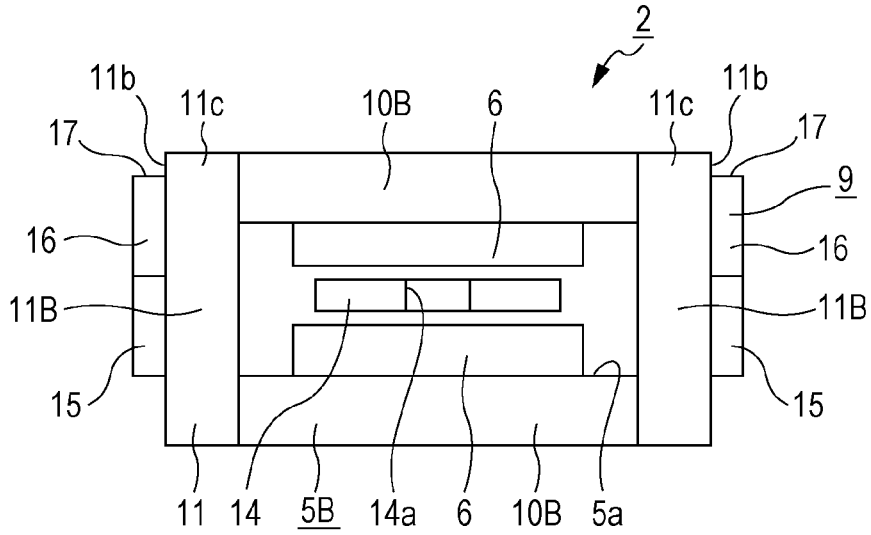
FIG. 6 is an enlarged front view illustrating an example wherein a yoke is made up of four members.

Though an example has been shown above wherein the yoke 5 is configured of the plate-shaped first member 10 and the U-shaped second member 11, the configuration of the yoke 5 is not restricted to this, and the following yokes 5A and 5B may be configured, for example (see FIGS. 5 and 6).

The yoke 5A is configured of a U-shaped first member 10A opened downward and a U-shaped second member 11A opened upward (see FIG. 5). The first member 10A and the second member 11A are attached to later-described fixed portions 16 of the armature 9 disposed on the outer face side, and are disposed in a manner vertically isolated, for example. With the yoke 5A as well, in the same way as with the yoke 5, optimization of distance in the vertical direction between the magnets 6 can be realized by performing positional adjustment of the first member 10A and the second member 11A.

The yoke 5B is configured by four of two plate-shaped first members 10B and two plate-shaped second members 11B being combined, which are vertically horizontally located (see FIG. 6). The first members 10B are located in a manner vertically isolated, and the second members 11B are located in a manner horizontally isolated. With the yoke 5B as well, optimization of distance in the vertical direction between the magnets 6 can be realized by performing positional adjustment between the first members 10B.

In this way, the number of members making up the yoke 5 is arbitrary as long as the number is greater than one, and distance adjustment of the multiple members is allowed in the vertically direction, whereby optimization of the distance in the vertical direction between the magnets 6 can be realized.

A coil 7 is formed in a tube shape with the axial direction being set as the forward/backward direction, which is formed in a slotted-hole shape as viewed from the forward/backward direction, for example (see FIGS. 1 and 3). The coil 7 is made up of regular winding, wherein the upper face and lower face are formed as attached faces 7*a* and 7*b* formed in a planar shape, respectively.

The circuit board 8 is attached to the attached face 7*a* of the coil 7. The circuit board 8 is configured so that the length in the forward/backward direction is longer than the length in the forward/backward direction of the coil 7, and generally the first half portion is attached to the attached face 7*a* of the coil 7. Accordingly, generally the second half portion of the circuit board 8 protrudes backward from the coil 7.

An unshown pair of connection terminal portions of the circuit board 8 are connected with both edge portions of the coil 7 respectively, and in a state in which both edge portions of the coil 7 are connected to the pair of connection terminal portions respectively, the circuit board 8 is attached to the attached face 7*a* of the coil 7 by adhesion or the like. The coil 7 is made up of regular winding, and the attached face 7*a* is formed in a planar shape, whereby a suitable joint state between the coil 7 and the circuit board 8 can be secured.

The armature 9 is configured by each portion being integrally formed of a magnetic metal material. Specifically, the armature 9 is configured by a coil attachment portion 12 facing the vertical direction, a joint portion 13 protruding upward from the rear edge portion of this coil attachment portion 12, a vibrating portion 14 protruding forward from the upper edge portion of this joint portion 13, side wall portions 15 protruding upward from both of left and right edge portions of the coil attachment portion 12 respectively, and fixed portions 16 protruding forward from the front faces of generally the first half portions of the side wall portions 15 respectively, being integrally formed.

With the vibrating portion 14, the length in the forward/backward direction is set to be longer than the length in the forward/backward direction of the coil attachment portion 12, and the front edge is located more forward than the front edge of the coil attachment portion 12. With the central portion in the horizontal direction of the front face of the vibrating portion 14, a joint recessed portion 14*a* opened forward is formed.

The upper faces of the side wall portions 15, and the upper faces of the fixed portions 16 are formed as the same planes, and the same planes located in a manner horizontally isolated are formed as fixed faces 17, respectively.

Figure 7:
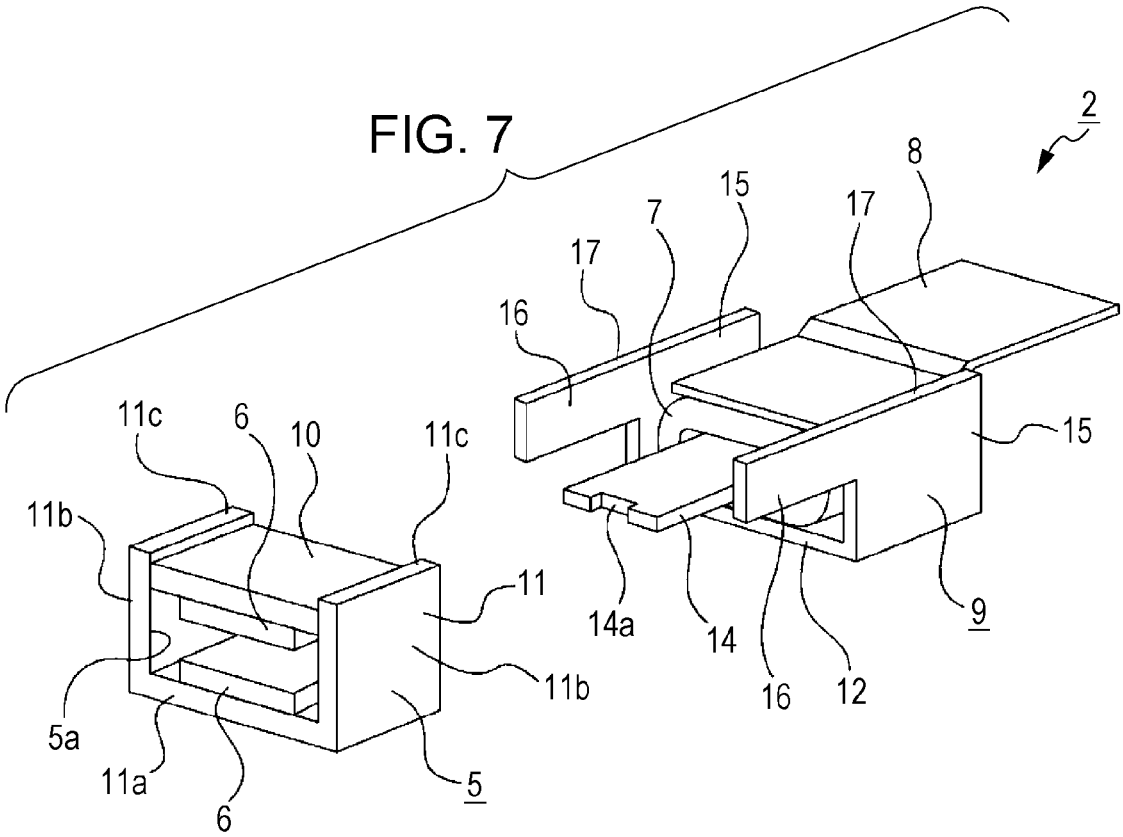
FIG. 7 is an enlarged exploded perspective view of the driving unit.

The upper face of the coil attachment portion 12 is attached with the coil 7 by adhesion, for example (see FIGS. 3 and 7). The coil 7 is made up of regular winding, and the lower face serving as the attached face 7*b* is formed in a planar shape, whereby a suitable joint state of the coil 7 as to the coil attachment portion 12 can be secured.

In a state in which the coil 7 is attached to the coil attachment portion 12, the coil 7 is in a state in which the vibrating portion 14 is passed through the coil 7, and a part thereof protrudes forward from the coil 7.

With the acoustic conversion device 1, both of the coil attachment portion 12 to which the coil 7 is attached, and the vibrating portion 14 passed through the coil 7 are provided to the armature 9. Accordingly, the position of the vibrating portion 14 as to the coil 7 can be secured with high precision, and improvement in the positional precision of the vibrating portion 14 as to the coil 7 can be realized.

Figure 8:
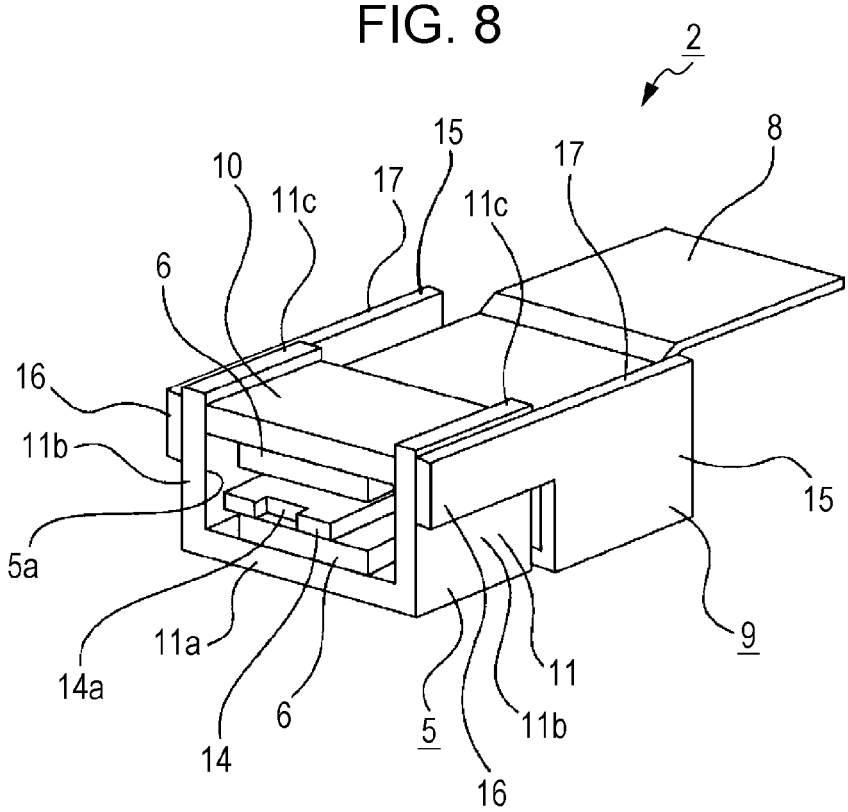
FIG. 8 is an enlarged perspective view of the driving unit.

With the armature 9, in a state in which the coil 7 is attached to the coil attachment portion 12, the fixed portions 16 are fixed to the outer faces of the side face portions 11*b* of the yoke 5 by adhesion, welding, or the like, respectively (see FIG. 8).

At the time of fixing work of the armature 9 as to the yoke 5, in order to secure a suitable magnetic balance, positional adjustment between the vibrating portion 14 and the magnets 6 is performed. In particular, with the acoustic conversion device 1, the yoke 5 is configured of the first member 10 and second member 11 which have different volume, and accordingly, though the magnetic balance may be out of balance in the vertical direction, a suitable magnetic balance can be secured by performing positional adjustment between the vibrating portion 14 and the magnets 6.

Figure 4:
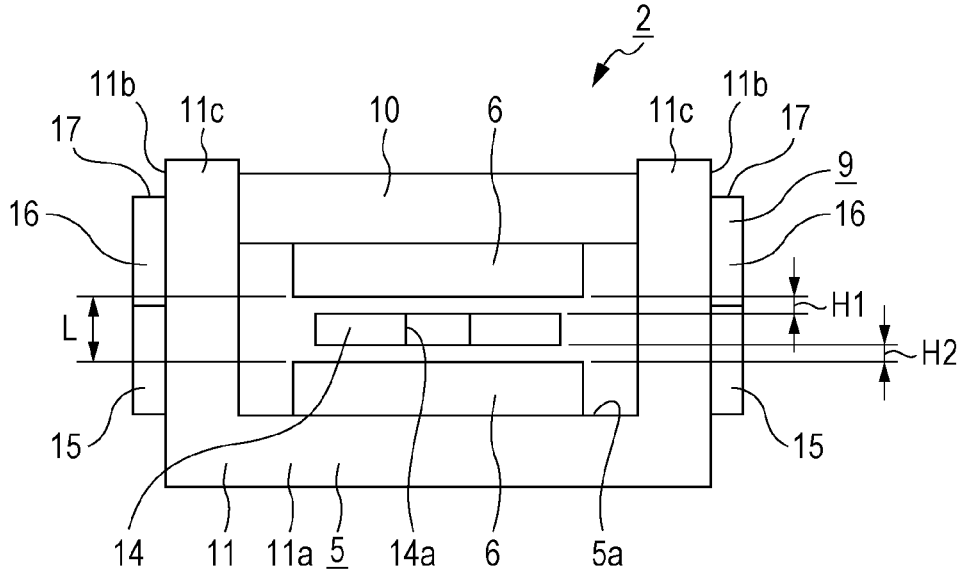
FIG. 4 is an enlarged front view of a driving unit.

Positional adjustment between the vibrating portion 14 and the magnets 6 is performed by adjusting the positions of the armature 9 and the yoke 5. Specifically, as illustrated in FIG. 4, gap adjustment of a gap H1 between one of the magnets 6 and the upper face of the vibrating portion 14, and a gap H2 between the other magnet 6 and the lower face of the vibrating portion 14, inclination adjustment of the vibrating portion 14 as to the magnets 6, or the like is performed.

At this time, with the acoustic conversion device 1, since the coil 7 is attached to the coil attachment portion 12 of the armature 9, the position of the vibrating portion 14 as to the coil 7 is not changed, and accordingly, when the positions of the vibrating portion 14 and the magnets 6 are adjusted, the positions as to the magnets 6 of the coil 7 are adjusted at the same time.

Accordingly, preliminary positional adjustment of the coil 7 as to the magnets 6 can be omitted, whereby improvement in workability can be realized.

Note that, with the acoustic conversion device 1, the yoke 5 is configured of the first member 10 and second member 11 which have different volume. Accordingly, for example, a magnetic balance may be adjusted by a technique, such that the first member 10 and the second member 11 are each formed with different thickness, the magnets 6 are each formed with different thickness, the magnets 6 are each made of a different material, the magnets 6 are configured so as to have different magnetic force, or the like.

In a state in which the armature 9 is fixed to the yoke 5, the upper faces of the side face portions 11*b* of the yoke 5 are located somewhat upward as compared to the fixing portions 17 of the armature 9 (see FIG. 4). Also, the joint recessed portion 14*a* formed in the front edge portion of the vibrating portion 14 is located somewhat forward as compared to beneath the front edge portions of the magnets 6.

Note that, though the armature 9 where each portion is integrally formed has been shown as an example, the armature may be configured as the following armature 9A or 9B (see FIGS. 9 and 10) as long as the armature is configured so that the vibrating portion serving as a portion to be magnetized is made of a magnetic metal material.

Figure 9:
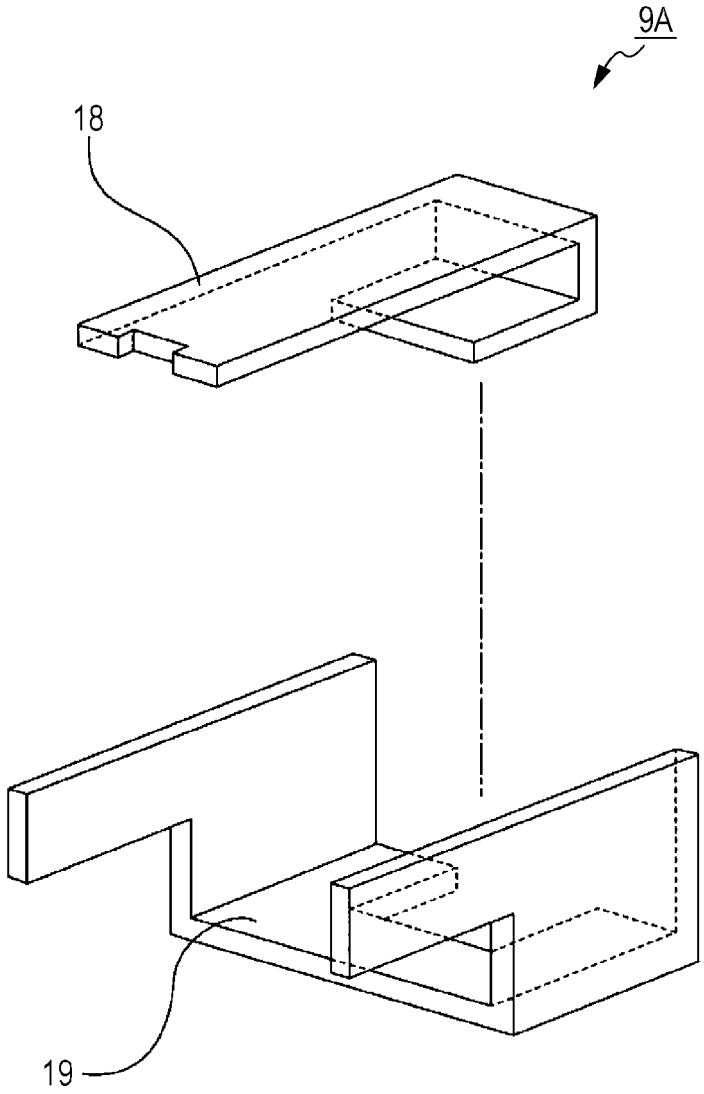
FIG. 9 is an enlarged perspective view illustrating an example wherein an armature is made up of two members.

The armature 9A is configured, as illustrated in FIG. 9, by a first member 18 including the vibrating portion 14, and a second member 19 including the fixed portions 16 being combined by adhesion or welding.

Figure 10:
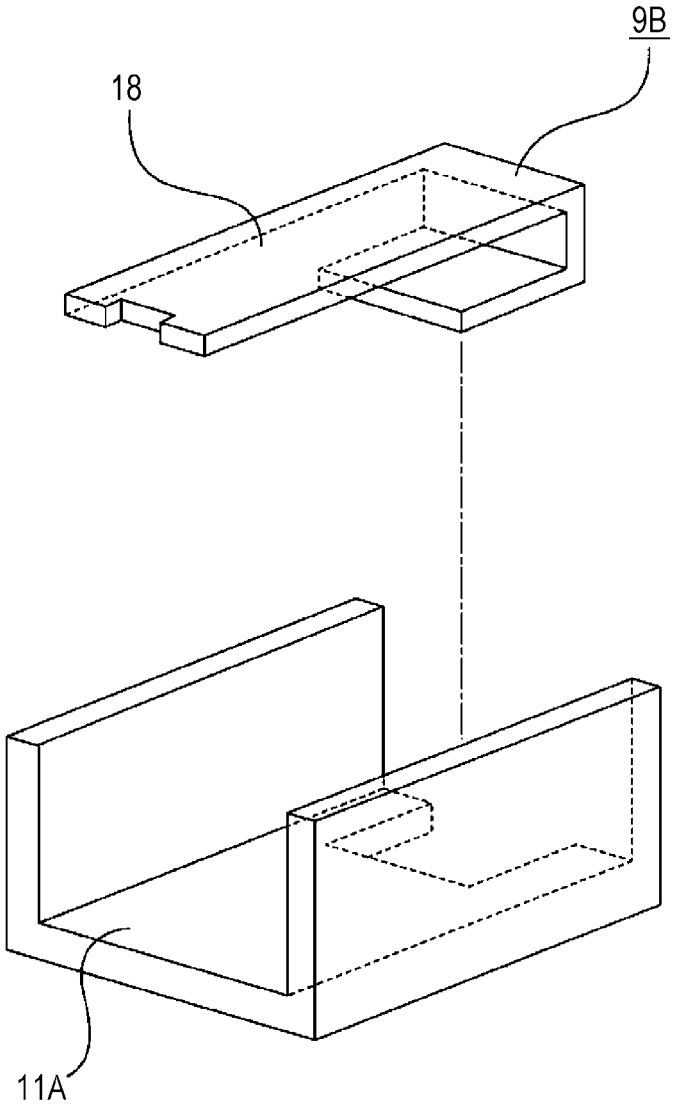
FIG. 10 is an enlarged perspective view illustrating an example wherein the armature is configured to be combined with the yoke.

The armature 9B is configured, as illustrated in FIG. 10, by the first member 18 including the vibrating portion 14, and a second member 11A of the yoke 5 being combined by adhesion or welding.

In this way, the first member 18 including the vibrating portion 14 is configured as a member different from the other portions, whereby the expensive first member 18 which has to be magnetized, and other portions which can be formed at low cost, can individually be formed, and reduction in manufacturing cost can be realized.

The diaphragm unit 3 is made up of a holding frame 20, a resin film 21, a diaphragm 22, and a beam portion 23 (see FIGS. 1 and 3).

The holding frame 20 is formed, for example, in a vertically long frame shape by a metal material, wherein the width in the horizontal direction is set to generally the same width as the width in the horizontal direction of the armature 9. With the holding frame 20, the lower face is taken as a first joint face 20*a*, and the upper face is taken as a second joint face 20*b*.

The size of the resin film 21 is set to the same as with the outer shape of the holding frame 20, and the resin film 21 is adhered onto the upper face 20*b* of the holding frame 20 by adhesion or the like so as to close the opening of the holding frame 20, for example.

With the diaphragm 22, the outer shape is formed in a rectangular shape having a size smaller than the inner shape of the holding frame 20, by a thin metal material, for example, aluminum or stainless steel. Three reinforcing ribs 22*a* located in a manner extending forward/backward and horizontally isolated are provided to the diaphragm 22, and the reinforcing ribs 22*a* are formed in a shape ticked out upward.

The diaphragm 22 is set in a state adhered to the resin film 21 from below.

Figure 11:
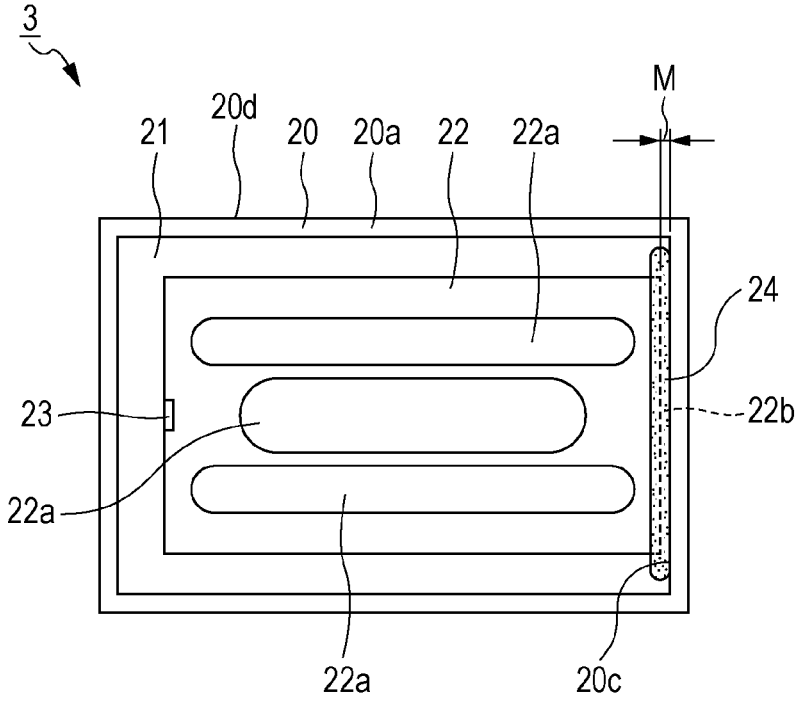
FIG. 11 is an enlarged bottom face view of a diaphragm unit.
Figure 12:
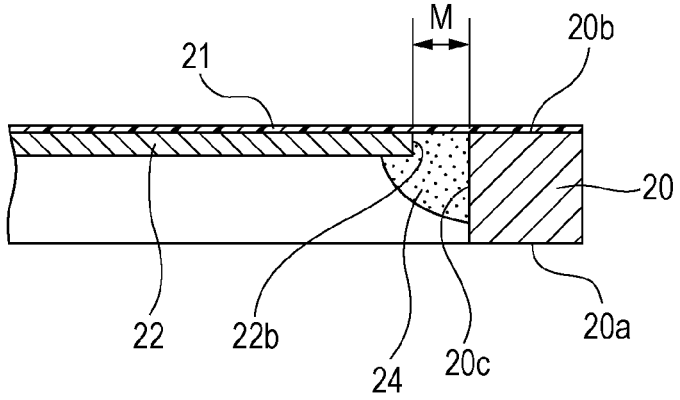
FIG. 12 in an enlarged cross-sectional view illustrating a state in which an adhesive agent is applied to a gap between the diaphragm and the holding frame.

The rear edge 22*b* of the diaphragm 22 is located somewhat forward as compared to the inner face 20*c* in the rear edge portion of the holding frame 20, and a gap M is formed between the rear edge 22*b* of the diaphragm 22, and the inner face 20*c* in the rear edge portion of the holding frame 20 (see FIGS. 11 and 12). The gap M is caused due to dimensional tolerance, assembly error, or the like between the diaphragm 22 and the holding frame 20, and is 0.1 mm or so, for example.

An adhesive agent 24 is applied to the diaphragm unit 3 so as to fill in the gap M. Accordingly, the diaphragm 22 and the holding frame 20 are combined via the adhesive agent 24, and the resin film 21. An acrylic non-curing adhesive agent or acrylic UV cure adhesive agent is used as the adhesive agent 24, for example.

Note that the adhesive agent 24 fills in the gap M and also extends on the opposite side of a side where the resin film 21 of the diaphragm 22 is adhered, i.e., the diaphragm 22 is supported on the holding frame 20 by the resin film 21, but the adhesive agent 24 serves as a reinforcing member for reinforcing this.

The beam portion 23 is formed integrally with the diaphragm 22, and is formed by a part of the diaphragm 22 being bent. The beam portion 23 is formed in a narrow plate shape vertically extending.

The diaphragm unit 3 is fixed to the driving unit 2 from above, for example, by adhesion or laser welding. The diaphragm unit 3 is fixed to the driving unit 2 by the first joint face 20*a* of the holding frame 20 being jointed to the fixing faces 17 of the armature 9.

Figure 13:
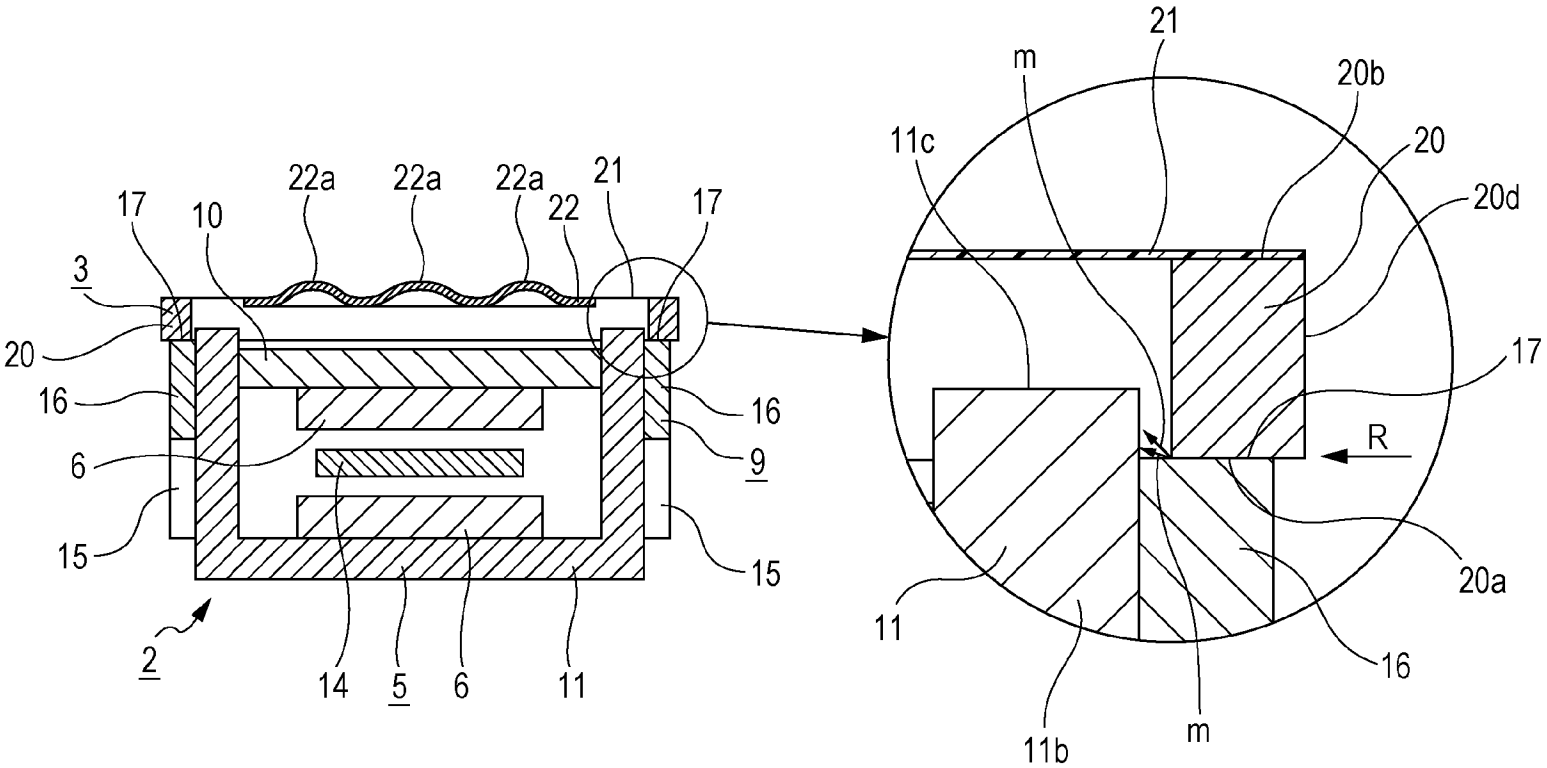
FIG. 13 is an enlarged cross-sectional view illustrating a state in which the diaphragm unit is fixed to the driving unit.

The first joint face 20*a* of the holding frame 20 is jointed to the fixing faces 17 of the armature 9, for example, by laser welding, and laser R is irradiated on the joint portion from the lateral side (see FIG. 13). At this time, as described above, the upper faces of the side face portions 11*b* of the yoke 5 are located somewhat upward as compared to the fixing faces 17 of the armature 9, and in the event that a plurality of metal m molten by irradiation of the laser R have scattered on the yoke 5 side, the plurality of scattered metal m collide with the outer faces of the upper edge portions on the side face portions 11*b*.

Accordingly, adhesion of the plurality of metals m scattered by the irradiation of the laser R to the resin film 21 can be prevented, and damage of the resin film 21 can be prevented. In this way, the upper edge portion of the side face portion 11*b* in the yoke 5 serves as a wall portion 11*c* for preventing scattering of the plurality of metal m, and it is desirable to locate the outer face of this wall portion 11*c*, and the inner face of the holding frame 20 in the closest position possible.

Also, with the acoustic conversion device 1, the upper face of the side face portion 11*b* in the yoke 5 is located upward as compared to the fixing faces 17 of the armature 9, whereby damage of the resin film 21 can be prevented, and damage of the resin film 21 can be prevented by a simple technique without increasing manufacturing costs.

Figure 14:
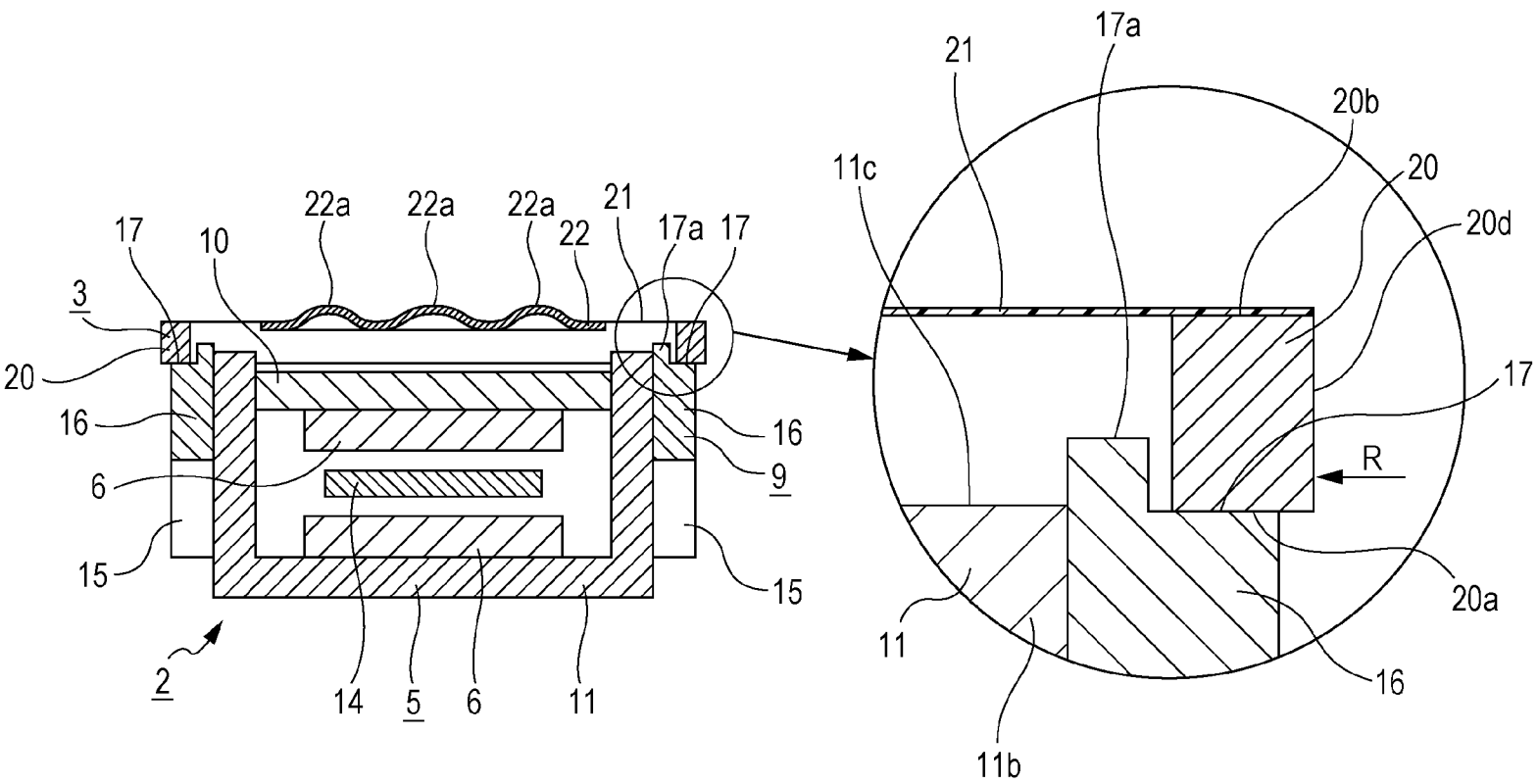
FIG. 14 is an enlarged cross-sectional view illustrating an example wherein a wall portion is provided to a fixed portion of the armature.

Note that an example has been shown above wherein the wall portion 11*c* for preventing scattering of the plurality of metal m is provided to the yoke 5, but for example, as illustrated in FIG. 14, wall portions 17*a* protruding upward may be provided to the fixing faces 17 of the armature 9, respectively.

In this way, the armature 9 can be fixed to the yoke 5 by providing the wall portions 17*a* to the armature 9 without considering the heights between the upper face of the yoke 5, and the fixing faces 17 of the armature 9, and damage of the resin film 21 can be prevented in addition to realizing improvement in the flexibility of designing.

Also, the wall portions 17*a* are provided to the armature 9, and accordingly, the fixing portions 17 are extended long in the forward/backward direction by the yoke 5, whereby the diaphragm unit 2 can tightly be fixed to the driving unit 2 by widening the irradiation range of the laser R.

Figure 15:
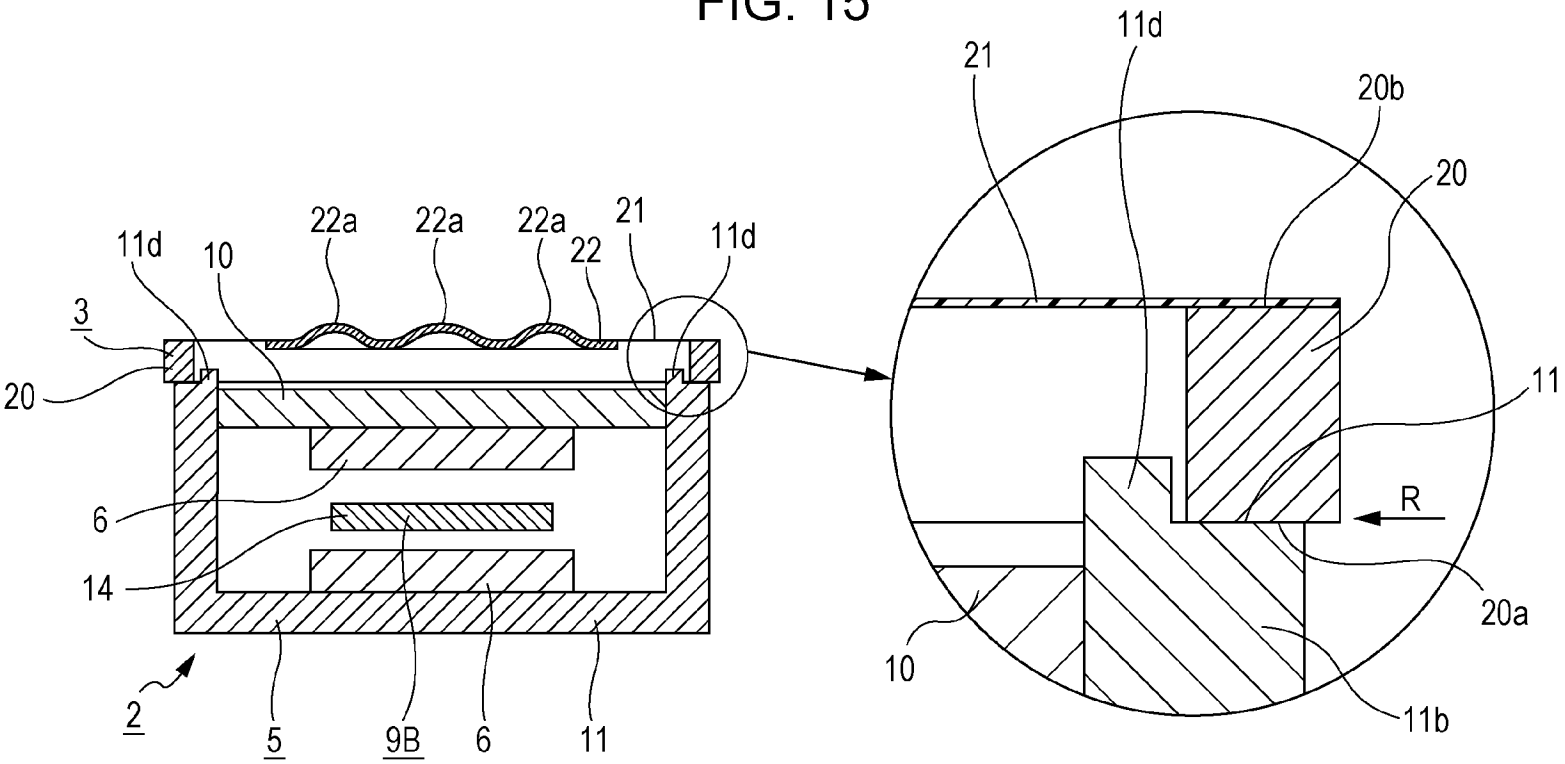
FIG. 15 is an enlarged cross-sectional view illustrating an example wherein a wall portion is provided to the yoke.

Further, like the armature 9B illustrated in FIG. 10, in the event that the fixed portions 16 are not provided, the holding frame 20 of the diaphragm unit 3 is fixed to the upper face of the yoke 5, but in this case, as illustrated in FIG. 15, wall portions 11*d* may be provided to the upper edge portions of the side face portions 11*b* of the yoke 5, respectively.

In this way, the holding frame 20 is fixed to the yoke 5, and the wall portions 11*d* are provided to the yoke 5, whereby damage of the resin film 21 can be prevented in addition to realizing reduction in the size of the acoustic conversion device 1 by an amount equivalent to that conserved by the fixed portions 16 of the armature 9 being omitted.

As described above, at the time of fixing the diaphragm unit 3 to the driving unit 2, the lower edge portion of the beam portion 23 is attached to the front edge portion of the vibrating portion 14 in the armature 9 by adhesion (see FIG. 3). The beam portion 23 is combined to the armature 9 by an adhesive agent 25 in a state inserted into the joint recessed portion 14*a* formed in the vibrating portion 14.

As described above, the beam portion 23 is formed integrally with the diaphragm 22, and accordingly, the diaphragm 22 and the armature 9 are combined via the beam portion 23 only by the lower edge portion of the beam portion 23 being attached to the vibrating portion 14, whereby improvement in working efficiency in joining between the diaphragm 22, beam portion 23, and armature 9 can be realized.

Also, the beam portion 23 is formed integrally with the diaphragm 22, and accordingly, attachment of the upper edge portion of the beam portion 23 as to the diaphragm 22 can be omitted in a state in which the lower edge of the beam portion 23 is attached to the vibrating portion 14 of the armature 9. Accordingly, attachment of the upper edge portion of the beam portion 23 as to the lower face of the diaphragm 22 by feel does not have to be performed, and improvement in yield can be realized without causing shifting of the combined position of the beam portion 23 as to the diaphragm 22, modification of the beam portion 23, bending of the beam portion 23 as to the diaphragm 22, and so forth.

Further, with the acoustic conversion device 1, the yoke 5 is formed in a square tubular shape penetrated forward and backward, and the opening on the front side is formed as the working opening 5*a*, whereby attachment work of the beam portion 23 as to the vibrating portion 14 can be performed from the working opening 5*a*, and improvement in workability can be realized. Also, the working opening 5*a* is formed in the yoke 5, whereby a UV cure adhesive agent can be employed as the adhesive agent 24 for bonding the beam portion 23 to the vibrating portion 14, and improvement in workability with joining of the beam portion 23 as to the vibrating portion 14 can be realized.

Note that a narrow plate shape vertically extending has been shown above as an example of the beam portion 23, but the shape of the beam portion 23 is not restricted to the narrow plate shape, and various types of shape can be employed such as beam portions 23A, 23B, 23C, and 23D illustrated in FIGS. 16 through 19, for example.

Figure 16:
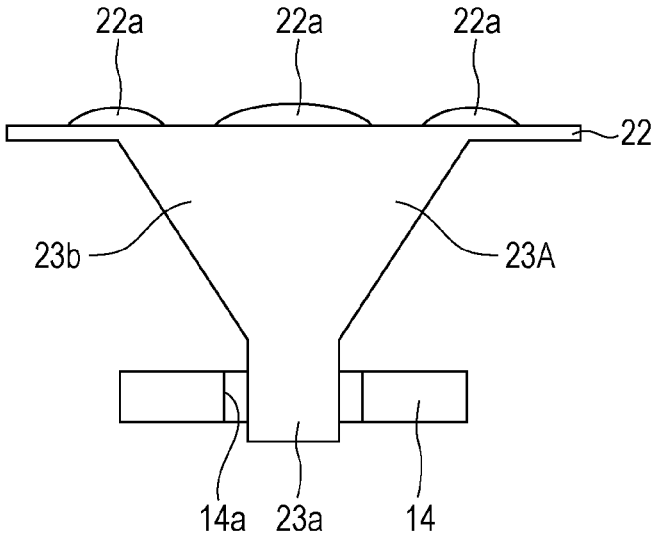
FIG. 16 is an enlarged front view illustrating a beam portion is formed with a shape of which the width widens as a base approaches the diaphragm, which illustrates a shape example of the beam portion along with FIGS. 17 through 19.

The beam portion 23A is provided, as illustrated in FIG. 16, as a narrow joint portion 23*a* of which the lower edge portion is combined to the vibrating portion 14, and is provided as a base 23*b* where as the upper side portion of the joint portion 23*a* advances upward, the width in the horizontal direction increases.

In this way, the beam portion 23A includes the base 23*b* where as the upper side portion of the joint portion 23*a* advances upward, the width in the horizontal direction increases, and accordingly, strength is high, whereby the vibration generated at the vibrating portion 14 can be propagated to the diaphragm 22 in a sure manner.

Figure 17:
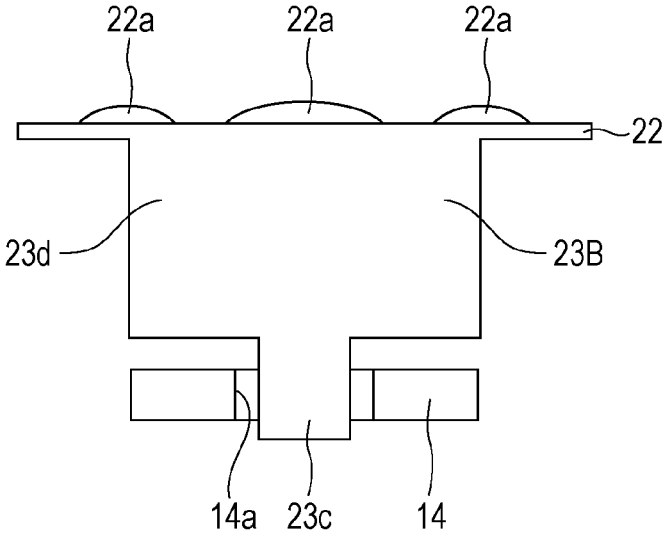
FIG. 17 is an enlarged front view illustrating an example wherein the base is formed with a shape of which the width is wider than that of a combined portion.

The beam portion 23B is provided, as illustrated in FIG. 17, as a narrow joint portion 23*c* of which the lower edge portion is combined to the vibrating portion 14, and is provided as a base 23*d* where the width in the horizontal direction of the upper side portion of the joint portion 23*c* is wider than the width of the joint portion 23*c*.

In this way, the beam portion 23B includes the base 23*d* of which the width is wider than the width of the joint portion 23*c*, and accordingly, strength is high, whereby the vibration generated at the vibrating portion 14 can be propagated to the diaphragm 22 in a sure manner.

Figure 18:
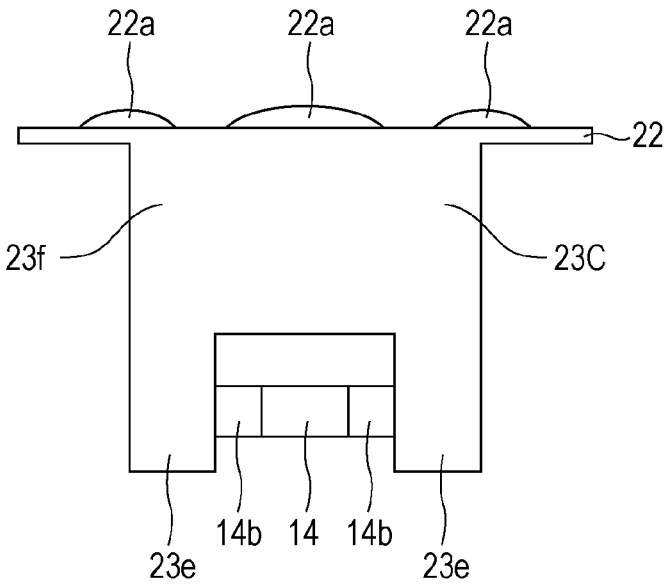
FIG. 18 is an enlarged front view illustrating an example wherein two combined portions are provided, and the base is formed with a shape of which the width is wide.

The beam portion 23C is provided, as illustrated in FIG. 18, as narrow joint portions 23*e* of which the lower edge portions are connected to the vibrating portion 14, located in a manner horizontally isolated, and is provided as a base 23*f* where the width in the horizontal direction is wider than the widths of the upper side portions of the joint portions 23*e*. The beam portion 23C includes the narrow joint portions 23*e* located in a manner horizontally isolated, and accordingly, two joint recessed portions 14*b* located in a manner horizontally isolated are provided to the vibrating portion 14.

In this way, the beam portion 23C includes the base 23*f* of which the width is wider than the widths of the joint portions 23*e*, and accordingly, strength is high, whereby the vibration generated at the vibrating portion 14 can be propagated to the diaphragm 22 in a sure manner. Also, the beam portion 23C includes the joint portions 23*e* located in a manner horizontally isolated, whereby stabilization of a joint state with the vibrating portion 14 can be realized.

Figure 19:
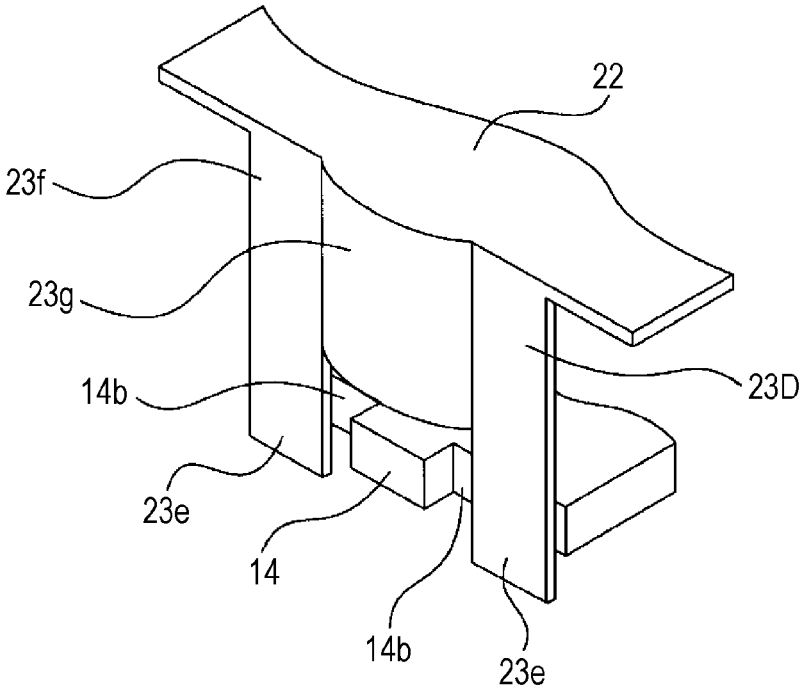
FIG. 19 is an enlarged perspective view illustrating an example wherein two combined portions are provided, and the base is formed with a shape of which the width is wide and is partially bent.

The beam portion 23D is provided, as illustrated in FIG. 19, as a bent portion 23*g* where the central portion of the base 23*f* is formed in a circular arc face shape protruding forward or backward.

In this way, the beam portion 23D includes the bent portion 23*g* formed in a circular arc face shape, whereby strength can further be increased.

Note that the beam portions 23 (23A, 23B, 23C, and 23D) are formed integrally with the vibrating portion 22, and are made of aluminum or stainless steel.

Reduction in weight can be realized by forming the diaphragm 22 using aluminum. On the other hand, strength is increased by forming the diaphragm 22 using stainless steel, whereby improvement in propagation efficiency of vibration from the vibrating portion 14 to the diaphragm 22 can be realized.

The storage unit 4 is configured of a box-shaped case body 26 opened upward, and a shallow box-shaped cover body 27 opened downward (see FIGS. 1 through 3).

An insertion notch 28*a* opened upward is formed on the upper edge portion of a rear face portion 28. With the inner face sides of the both edge portions of the case body 26, three installation stepped faces 26*a* which each face upward are formed.

With the cover body 27, an audio output hole 29*a* penetrated forward and backward is formed in a front face portion 29.

Acoustic Conversion Device Assembly Method

Hereafter, an assembly method of the acoustic conversion device 1 will be described (see FIGS. 20 through 25).

Figure 20:
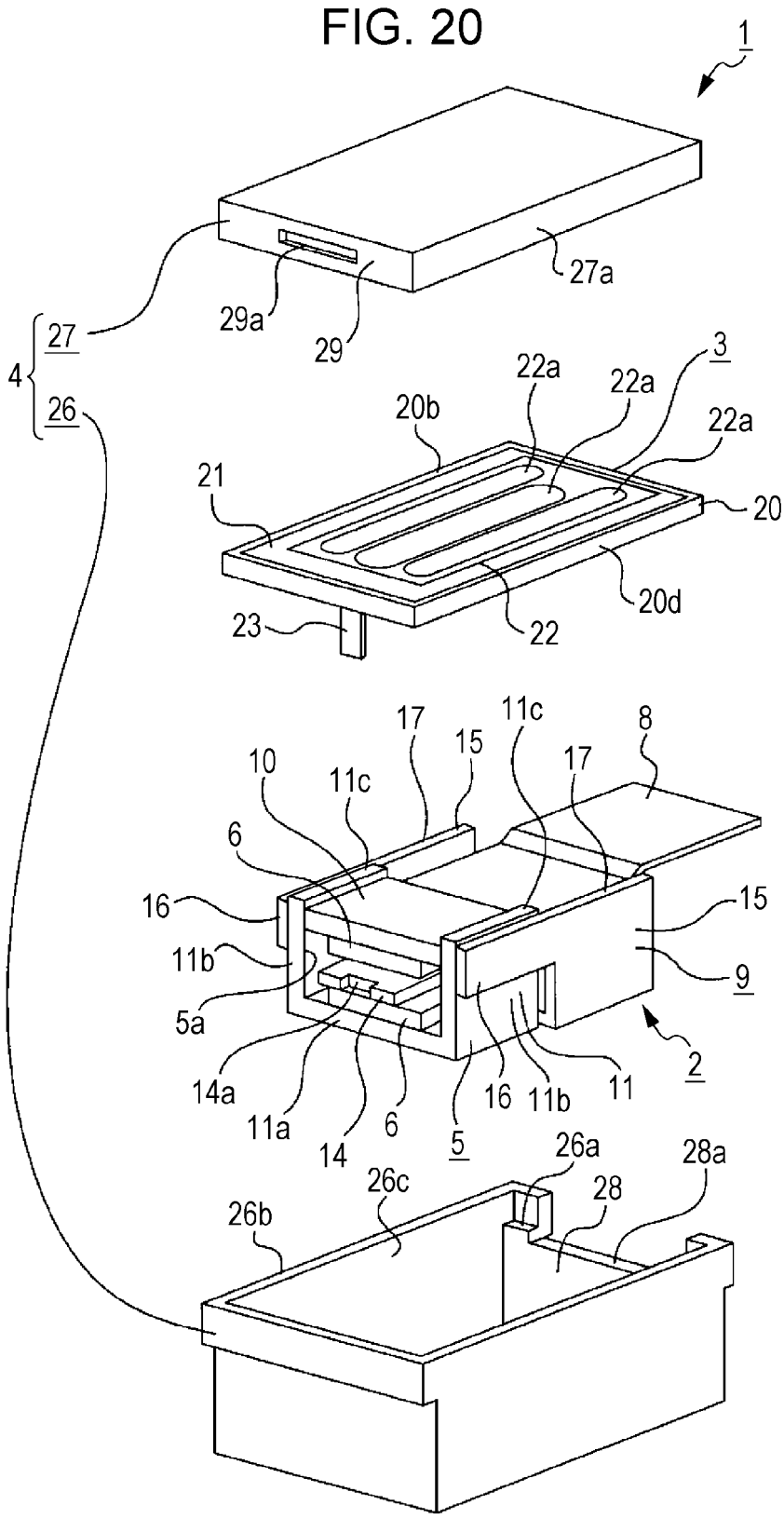
FIG. 20 is an exploded perspective view illustrating a state before the driving unit, diaphragm unit, and storage unit are combined, which illustrates an acoustic conversion device assembly method along with FIGS. 21 through 25.

First, as described above, the driving unit 2 is assembled using the yoke 5, magnets 6, coil 7, circuit board 8, and armature 9, and the diaphragm unit 3 is assembled using the holding frame 20, resin film 21, diaphragm 22, and beam portion 23 (see FIG. 20).

Figure 21:
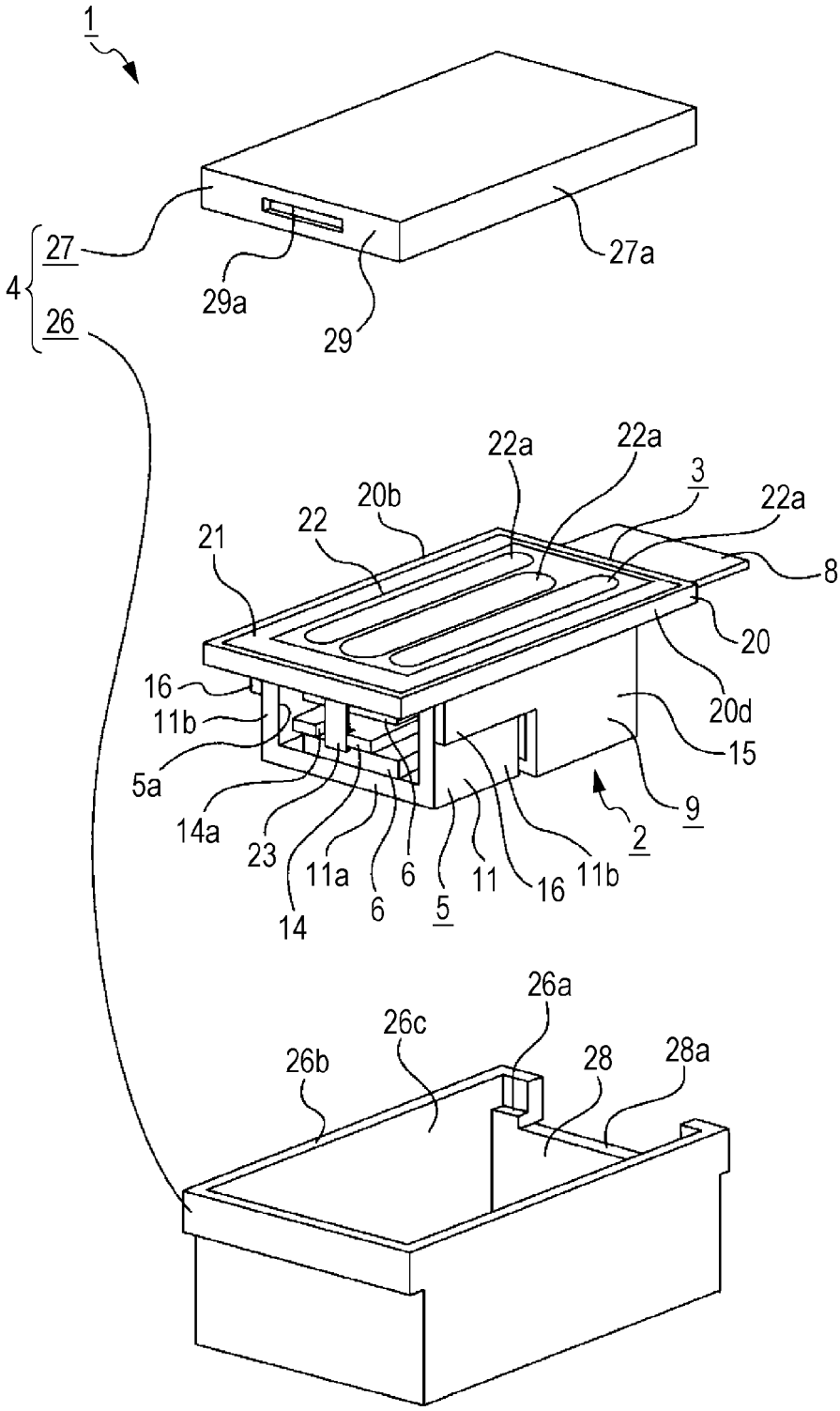
FIG. 21 is an exploded perspective view illustrating state in which the driving unit is fixed to the diaphragm unit.

Next, as described above, the diaphragm unit 3 is fixed to the driving unit 2 (see FIG. 21). Fixing of the diaphragm unit 3 as to the driving unit 2 is performed by jointing the first joint face 20*a* of the holding frame 20 to the fixing portions 17 of the armature 9. At this time, the lower edge portion of the beam portion 23 is attached to the front edge portion of the vibrating portion 14 in the armature 9 by the adhesive agent 25.

Figure 22:
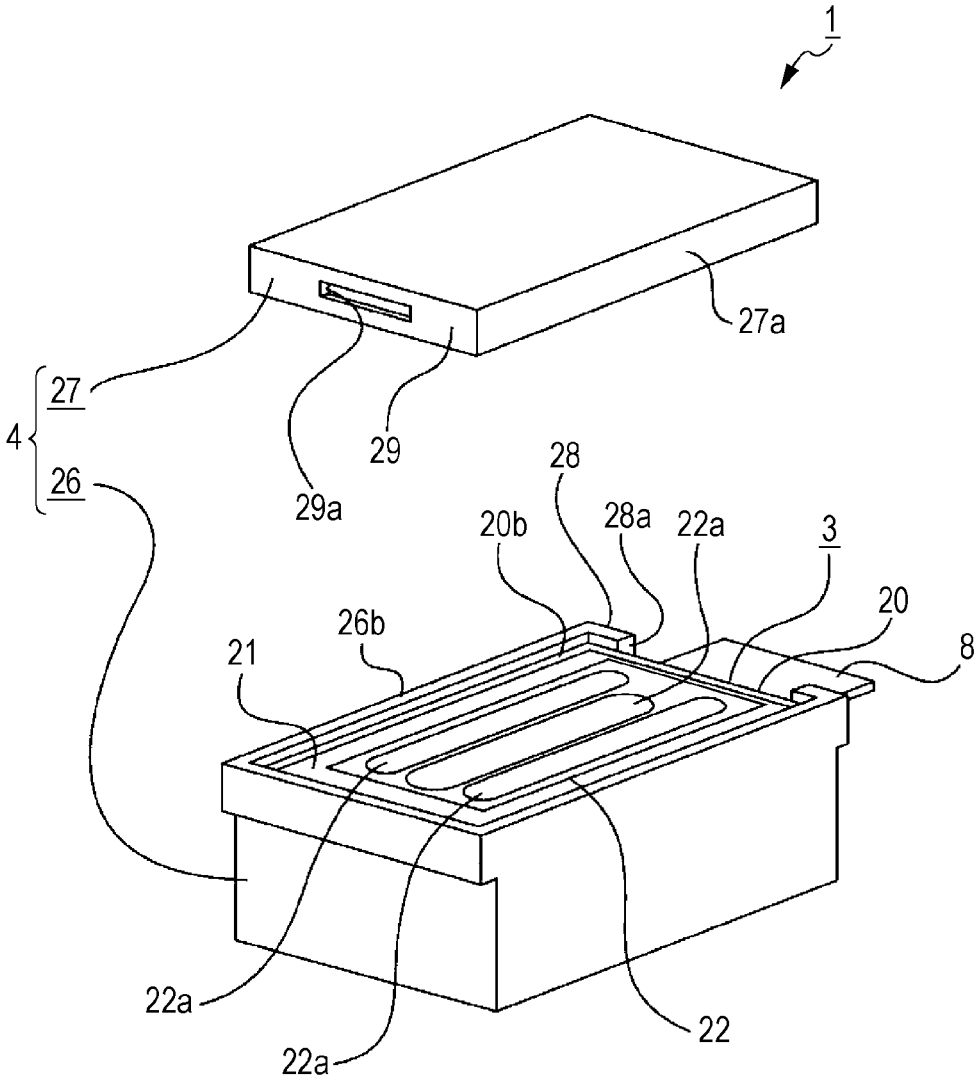
FIG. 22 is an exploded perspective view illustrating a state in which the driving unit and diaphragm unit are stored in the case body.

Next, the driving unit 2 and the diaphragm unit 3 are stored in the case body 26 from above (see FIG. 22). With the diaphragm unit 3 stored in the case body 26, both edge portions of the holding frame 20 are installed on the installation stepped faces 26*a* of the case body 26 respectively, and thus, positioning is determined. At this time, a predetermined gap is formed between the lower face of the driving unit 2, and the upper face of the bottom face portion of the case body 26.

Figure 23:
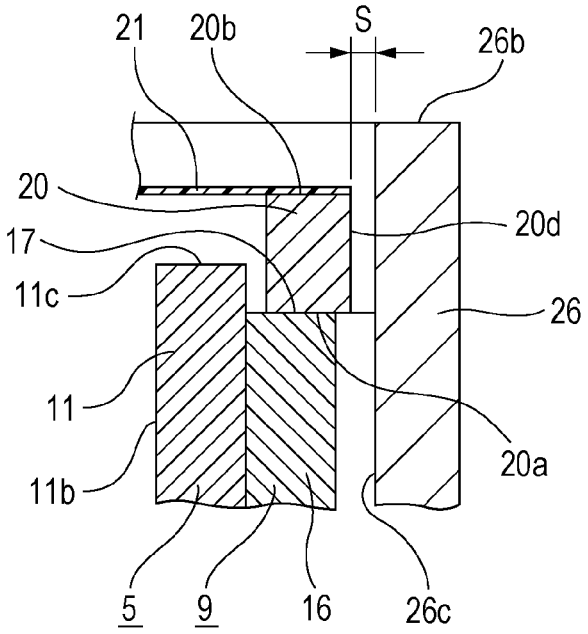
FIG. 23 is an enlarged cross-sectional view illustrating a state before a sealing agent is loaded in the holding frame of the diaphragm unit.

In a state in which the driving unit 2 and the diaphragm unit 3 are stored in the case body 26, the second joint face 20*b* of the holding frame 20 is located somewhat downward on the immediately inner side of the upper edge face 26*b* of the case body 26 (see FIG. 23). At this time, a gap S is formed between the outer face 20*d* of the holding frame 20, and the inner face 26*c* of the case body 26.

Also, in a state in which the driving unit 2 and the diaphragm unit 3 are stored in the case body 26, generally the second half portion of the circuit board 8 attached to the coil 7 protrudes backward from the insertion notch 28*a* of the case body 26.

Figure 24:
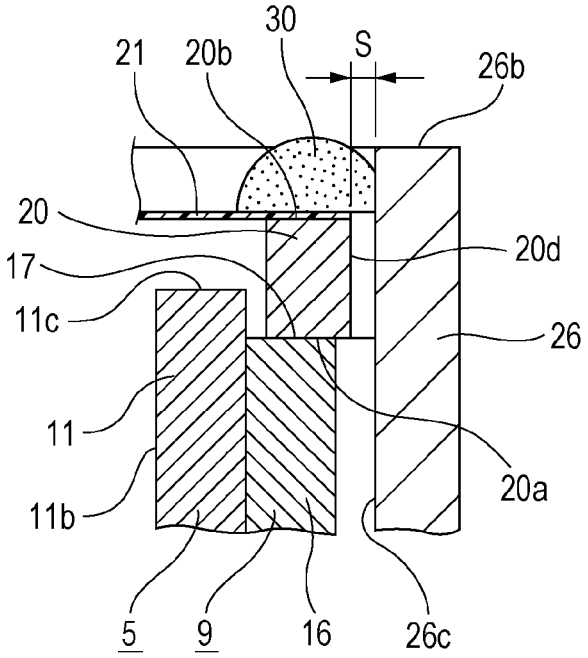
FIG. 24 is an enlarged cross-sectional view illustrating a state in which the sealing agent is loaded in the holding frame of the diaphragm unit.

Next, a sealing agent 30 is loaded in the second joint face 20*b* of the holding frame 20 (see FIG. 24). The sealing agent 30 also has an adhesive property.

Figure 25:
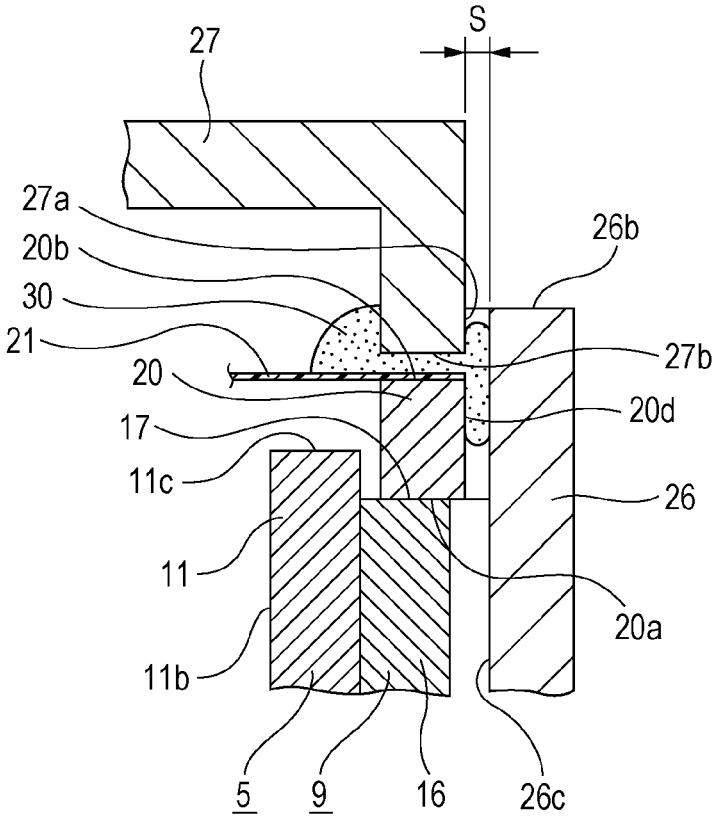
FIG. 25 is an enlarged cross-sectional view illustrating a state in which the sealing agent loaded in the holding frame of the diaphragm unit is pressedly deformed by the cover body, and the sealing agent is loaded in a gap.

Next, the cover body 27 is pressed against the sealing agent 30 loaded in the second joint face 20*b* from above to pressedly deform this (see FIG. 25). Upon pressedly deforming the sealing agent 30, this sealing agent 30 enters a gap between the outer face 20*d* of the holding frame 20, and the inner face 26*c* of the case body 26, and a gap between the outer face 27*a* of the cover body 27, and the inner face 26*c* of the case body 26, and thus, the gap S is sealed. Also, the sealing agent 30 remains between the second joint face 20*b* of the holding frame 20, and the lower edge face 27*b* of the cover body 27, and also enters the inner side of the holding frame 20, and a gap between the holding frame 20 and the cover body 27 is sealed.

Accordingly, the cover body 27 is pressed against the sealing agent 30 from above to pressedly deform this, and accordingly, each gap between the holding frame 20, cover body 27, and case body 26 is sealed, and these three are adhered and combined.

At this time, the lower face of the cover body 27 is disposed lower and inner than the upper face of the case body 26.

In this way, with the acoustic conversion device 1, one-time work only for covering the holding frame 20 by the cover body 27 to pressedly deform the sealing agent 30 is performed, and accordingly, each gap between the holding frame 20, cover body 27, and case body 26 is sealed, whereby improvement in workability with the assembly work of the acoustic conversion device 1 can be realized.

Figure 26:
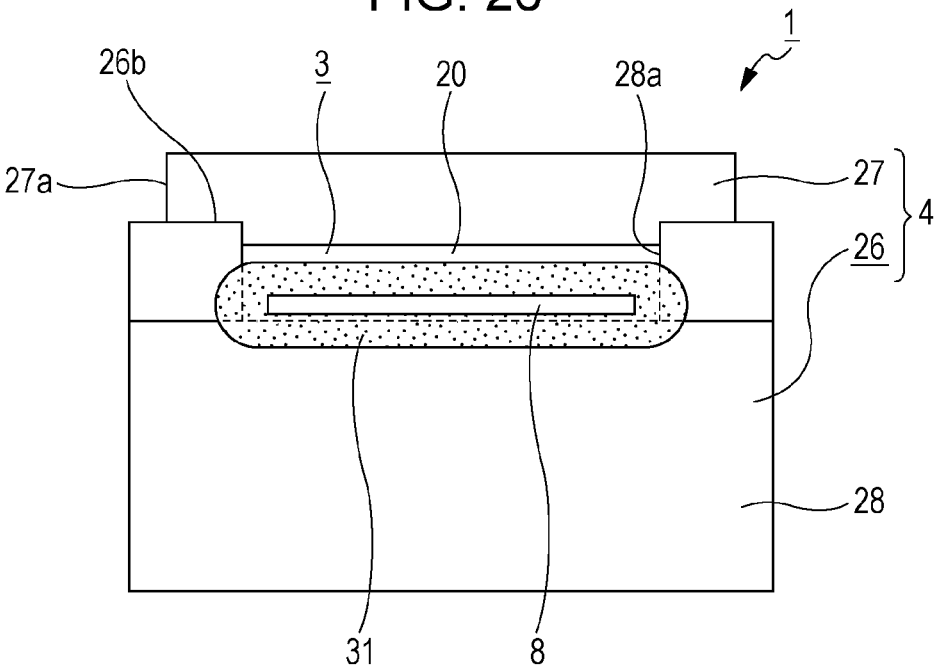
FIG. 26 is an enlarged back view of the acoustic conversion device.

Next, a sealing agent (adhesive agent) 31 is applied to a gap between the opening edge of the insertion notch 28*a* and the circuit board 28 in the case body 26 to perform sealing and adhesion (see FIG. 26).

Lastly, the portion of the circuit board 8 protruding backward from the case body 26 is connected with a connection code and a connection terminal for supplying power to the coil 7.

With the acoustic conversion device 1, as described above, the circuit board 8 is adhered to the coil 7 for connection, so laying wiring can be omitted, and improvement in working efficiency can be realized.

Figure 27:
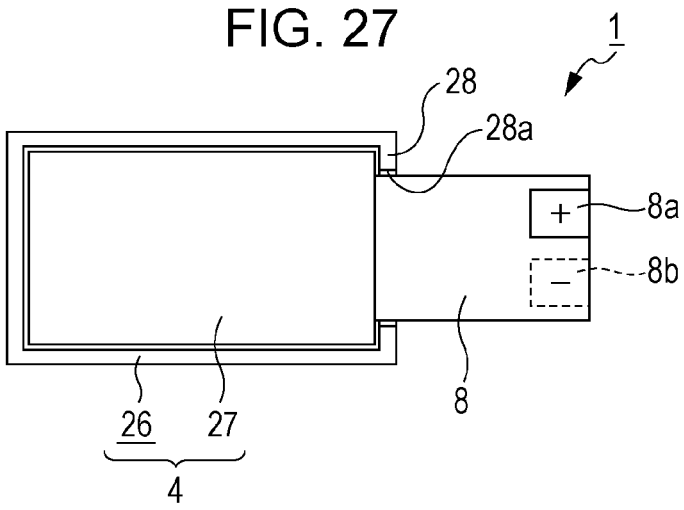
FIG. 27 is an enlarged plan view illustrating an example wherein a terminal portion is provided to both sides of a circuit board.

Note that there are provided a pair of terminal portions 8*a* and 8*b* of a plus pole and a minus pole where the connection code or connection terminal is connected, and the terminal portions 8*a* and 8*b* are located on both sides of the circuit board 8 respectively (see FIG. 27).

In this way, the terminal portions 8*a* and 8*b* are provided to both sides of the circuit board 8 respectively, whereby electric short-circuiting can be prevented at the time of connecting the connection code or connection terminal, and specifically at the time of connecting by soldering.

Figure 28:
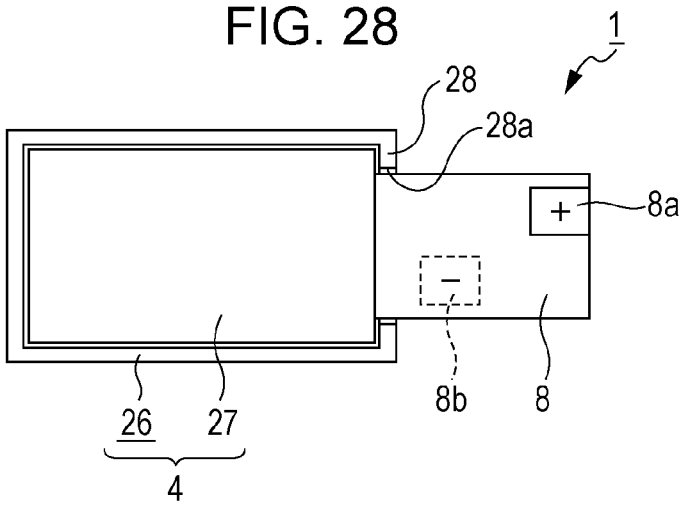
FIG. 28 is an enlarged plan view illustrating an example wherein a terminal portion is provided to both sides of the circuit board in a manner isolated forward and backward.
Figure 29:
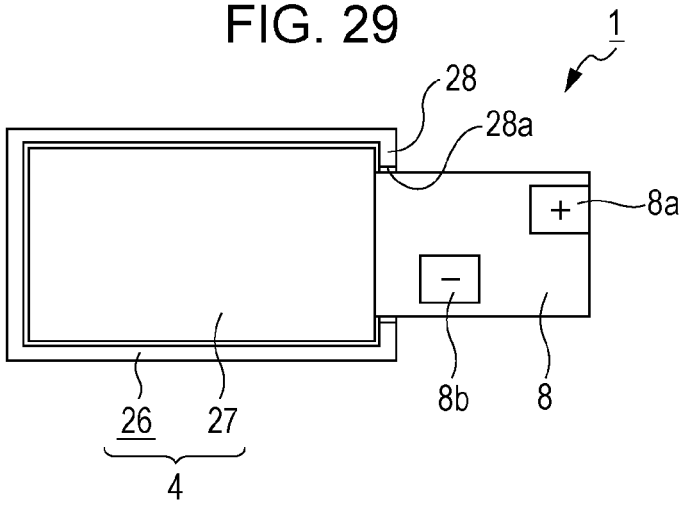
FIG. 29 is an enlarged plan view illustrating an example wherein a terminal portion is provided to the surface of the circuit board in a manner isolated forward and backward.

Also, the terminal portions 8*a* and 8*b* may be located in the circuit board 8 in a manner isolated forward or backward in a state provided on both sides of the circuit board 8 (see FIG. 28), or may be located in a manner isolated forward or backward in a state provided on one of both sides of the circuit board 8 (see FIG. 29).

In this way, even in the event that the terminal portions 8*a* and 8*b* are located in a manner isolated forward or backward, electric short-circuiting at the time of connecting the connection code or connection terminal can be prevented.

Note that an example has been shown above wherein the folding frame 20 to which the resin film 21 is adhered is attached between the case body 26 and the cover body 27, but an arrangement may be made wherein the resin film 21 is adhered between the case body 26 and the cover body 27 without providing the holding frame 20.

Acoustic Properties

With the acoustic conversion device 1, upon current being supplied to the coil 7, the vibrating portion 14 of the armature 9 located between the pair of magnets 6 is magnetized, and the polarity of this vibrating portion 14 is repeatedly changed at a position facing the magnets 6. Minute vibration is generated at the vibrating portion 14 by the polarity being repeatedly changed, the generated vibration is propagated from the beam portion 23 to the diaphragm 22, and the propagated vibration is amplified at the diaphragm 22, converted into audio, and output from the audio output hole 29*a* of the cover body 27.

At this time, in order to realize improvement in acoustic properties by suppressing variation in sound pressure in the frequency region of the output audio, it is desirable to clearly generate a tertiary resonance peak existing in this frequency region, and specifically, in a high-frequency region.

With the acoustic conversion device 1, as described above, the adhesive agent 24 is applied so that the rear edge 22*b* of the diaphragm 22 is located somewhat forward as compared the inner face 20*c* of the rear edge portion of the holding frame 20, and the gap M between the rear edge 22*b* of the diaphragm 22, and the inner face 20*c* of the rear edge portion of the holding frame 20 is filled (see FIGS. 11 and 12). Accordingly, the diaphragm 22 and the holding frame 20 are in a state combined via the adhesive agent 24 and the resin film 21.

Figure 30:
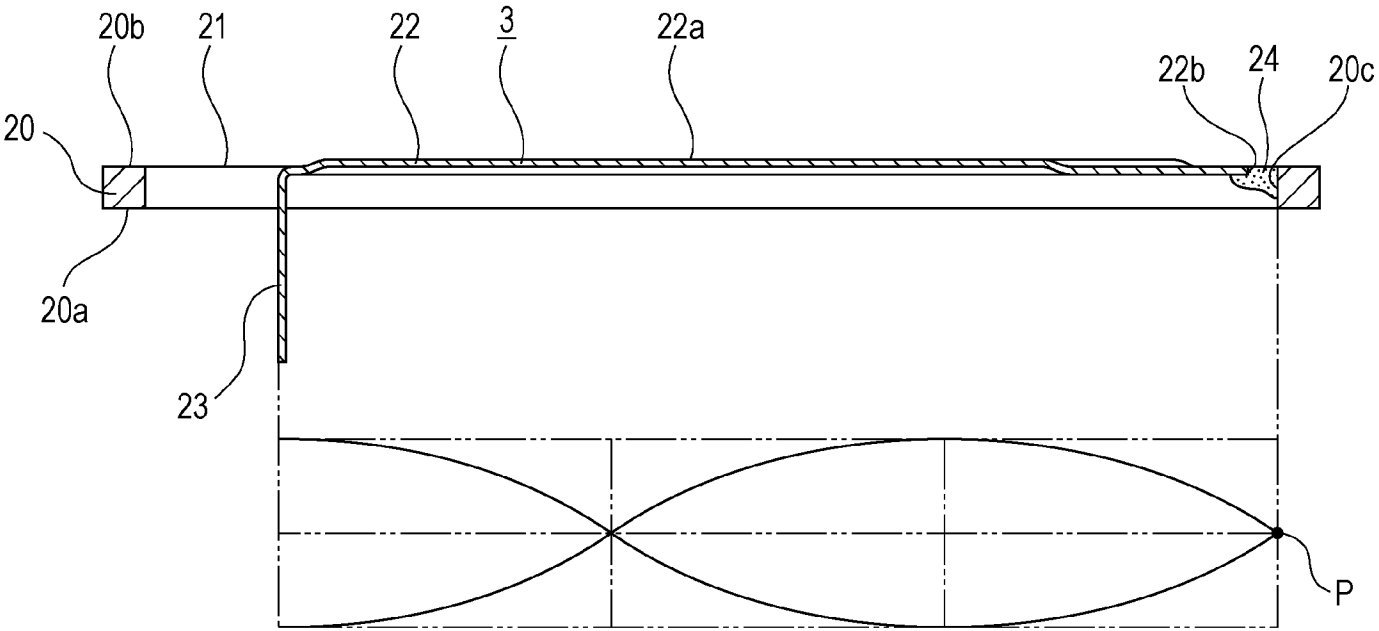
FIG. 30 is a diagram illustrating relationship between the fulcrum of vibration and tertiary resonance.

In this way, the adhesive agent 24 is applied so as to fill the gap M between the rear edge 22*b* of the diaphragm 22, and the inner face 20*c* of the holding frame 20, and accordingly, the portion where the adhesive agent 24 is applied becomes a clear fulcrum (vibration fulcrum) P for generating tertiary resonance (see FIG. 30). Accordingly, variation in the sound pressure in the frequency region in the acoustic conversion device 1, and specifically, in a high-frequency region is suppressed, whereby stable sound pressure can be obtained, and improvement in acoustic properties can be realized.

Hereafter, results obtained by measuring acoustic properties will be described (see FIGS. 31 and 32).

Figure 31:
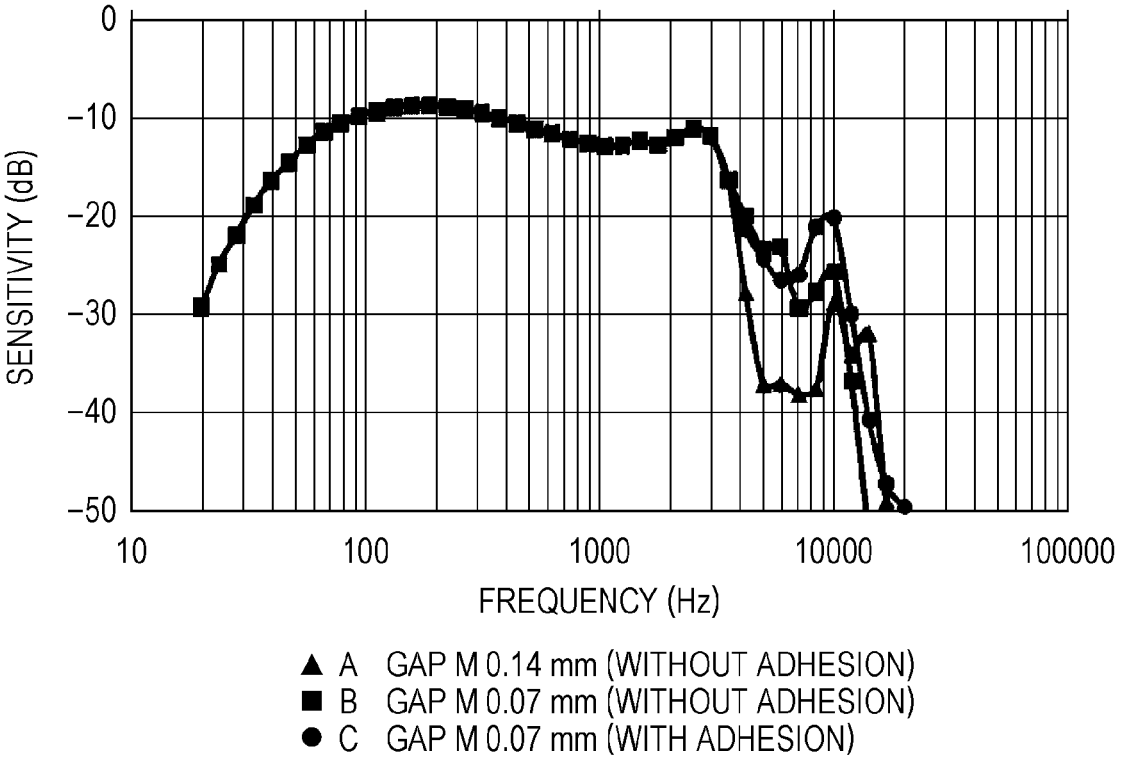
FIG. 31 is a graph chart illustrating a measurement result regarding acoustic properties.
Figure 32:
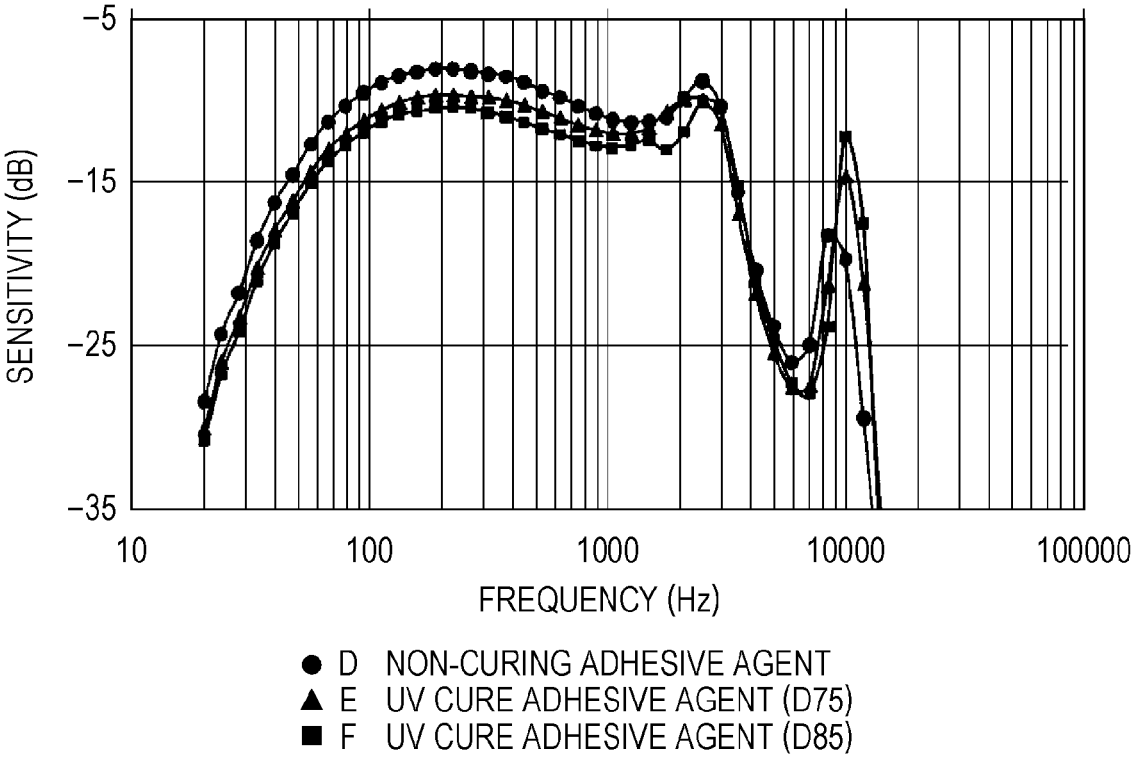
FIG. 32 is a graph chart illustrating another measurement result regarding the acoustic properties.

FIGS. 31 and 32 are graph charts in which the horizontal axis represents frequency (Hz), and the vertical axis represents sensitivity (dB).

In FIG. 31, A indicates a state in which the gap M is set to 0.14 mm, and no adhesive agent is applied to the gap M, B indicates a state in which the gap M is set to 0.07 mm, and no adhesive agent is applied to the gap M, and C indicates a state in which the gap M is set to 0.07 mm, and an adhesive agent is applied to the gap M. The adhesive agent used in C is an acrylic non-curing adhesive agent (pressure sensitive adhesive agent), and the viscosity is set to 100 through 3000 mPa·s.

According to comparison between A and B in FIG. 31, though almost no difference in sensitivity is seen in the frequency region of 3000 through 4000 Hz or less, it can be found that sensitivity deteriorates when the gap M increases in a high-frequency region.

Also, according to comparison between B and C in FIG. 31, in the event that the gap M is constant, though almost no difference in sensitivity is seen depending on whether or not application of the adhesive agent has been performed in the frequency region of 3000 through 4000 Hz or less, it can be found that sensitivity is increased due to application of the adhesive agent in a high-frequency region.

FIG. 32 shows measurement results when changing the adhesive agent to be applied to the gap M with the value of the gap M held constant.

In FIG. 32, D indicates a state in which the same acrylic non-curing adhesive agent as that in C in FIG. 31 has been applied to the gap M, E indicates a state in which an acrylic UV cure adhesive agent of which the degree of hardness is D (shore) 75 has been applied to the gap M, and F indicates a state in which an acrylic UV cure adhesive agent of which the degree of hardness is D (shore) 85 has been applied to the gap M. The hardness of the non-curing adhesive agent in D is lower than the hardness of the UV cure adhesive agent in E.

According to comparison between A, B, and C in FIG. 32, it can be found that with the frequency region of 3000 through 4000 Hz or less, an adhesive agent of which the hardness is lower is higher in sensitivity, and with the frequency region of 10000 Hz or less, an adhesive agent of which the hardness is higher is higher in sensitivity.

According to the above measurement results, a non-curing adhesive agent is employed as the adhesive agent 24, whereby improvement in sensitivity can be realized in high frequency, and improvement in acoustic properties can be realized, without decreasing low-frequency sensitivity.

Also, a UV cure adhesive agent is employed as the adhesive agent 24, whereby improvement in sensitivity can be realized in high frequency, and improvement in acoustic properties can be realized.

In Particular, an acrylic UV cure adhesive agent is employed as the adhesive agent 24, whereby improvement in acoustic properties can be realized in addition to securing suitable adhesive strength and reduction in adhesion process.

The specific shape and configuration of each portion shown in the above preferred embodiment are all a mere example of instantiation at the time of implementing the present disclosure, and the technical scope of the present disclosure is not to be interpreted in a limited manner by these.

The present disclosure contains subject matter related to that disclosed in Japanese Priority Patent Application JP 2010-137897 filed in the Japan Patent Office on Jun. 17, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An acoustic conversion device comprising:

(a) a driving unit including a pair of magnets disposed so as to face one another, a yoke to which said pair of magnets are attached, a coil to which driving current is supplied, a vibrating portion which vibrates when driving current is supplied to said coil, and an armature fixed to said yoke and disposed between said pair of magnets with said vibrating portion being passed through said coil;

(b) a diaphragm unit including a holding frame having an opening, fixed to said driving unit, with one face being taken as a first joint face to be jointed to said driving unit, and a face on the opposite side of said one face being taken as a second joint face, a resin film adhered to said holding frame in a state covering said opening of said holding frame, a diaphragm held on an inner side of said holding frame in a state adhered to said resin film, and a beam portion of which both edge portions are combined with said diaphragm and said vibrating portion of said armature respective, for propagating the vibration of said vibrating portion to said diaphragm; and (c) a storage unit having a case body and a cover body for storing said driving unit and said diaphragm unit, said storage unit having an audio output hole for outputting audio generated as vibrations are propagated to said diaphragm;

wherein, in a state in which said driving unit and said diaphragm unit are inserted into said case body, said cover body is pressed against a sealing agent loaded in said second joint face of said holding frame from a side facing said second joint face such that said sealing agent is pressedly deformed, and a gap that is defined by said case body, said cover body, and said holding frame is sealed by said sealing agent.

2. The acoustic conversion device according to claim 1, wherein:

said yoke has a pair of side face portions which face one another in a direction orthogonal to a direction where said pair of magnets face;

said armature has a pair of fixed portions fixed to the outer faces of a pair of side face portions of said yoke respectively;

each of said armature and said holding frame is formed of a metal material;

said first joint face of said holding frame is jointed to said pair of fixed portions of said armature by laser welding so that said diaphragm unit is fixed to said driving unit;

each edge face to which said first joint face in said pair of fixed portions is jointed is formed as a fixing face; and a wall portion protruding on said first joint face side from each of said fixing faces is provided to said pair of side face portions.

3. The acoustic conversion device according to claim 1, wherein:

said yoke has a pair of side face portions which face one another in a direction orthogonal to a direction where said pair of magnets face;

said armature has a pair of fixed portions fixed to the outer faces of a pair of side face portions of said yoke respectively;

each of said armature and said holding frame is formed of a metal material;

wherein said first joint face of said holding frame is jointed to said pair of fixed portions of said armature by laser welding so that said diaphragm unit is fixed to said driving unit;

each edge face to which said first joint face in said pair of fixed portions is jointed is formed as a fixing face; and a wall portion protruding on said first joint face side from each of said fixing faces positioned on an inner side of each of said fixing faces is provided to said pair of fixed portions.

4. The acoustic conversion device according to claim 1, wherein:

said yoke has a pair of side face portions which face one another in a direction orthogonal to a direction where said pair of magnets face are provided;

each of said yoke and said holding frame is formed of a metal material;

said first joint face of said holding flame is jointed to said pair of side face portions of said yoke by laser welding so that said diaphragm unit is fixed to said driving unit;

each edge face to which said first joint face in said pair of side face portions is jointed is formed as a fixing face; and a wall portion protruding on said first joint face side from each of said fixing faces positioned on an inner side of each of said fixing faces is provided to said pair of side face portions.

5. The acoustic conversion device according to claim 1, wherein in a state in which said driving unit and said diaphragm unit are inserted into said case body, lower faces of said holding frame and said cover body are disposed so as to be lower than an upper face of said case body, and also disposed on an inner side of said case body.

6. The acoustic conversion device of claim 1, wherein said sealing agent also seals a gap between said holding frame and said cover body.

* * * * *